US009352599B2

(12) United States Patent
Sakano et al.

(10) Patent No.: US 9,352,599 B2
(45) Date of Patent: May 31, 2016

(54) TAPE CARTRIDGE

(71) Applicant: Seiko Epson Corporation, Tokyo (JP)

(72) Inventors: Hideki Sakano, Suwa (JP); Hideo Sodeyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/741,284

(22) Filed: Jun. 16, 2015

(65) Prior Publication Data

US 2015/0283836 A1 Oct. 8, 2015

Related U.S. Application Data

(63) Continuation of application No. PCT/JP2015/058314, filed on Mar. 19, 2015.

(30) Foreign Application Priority Data

Mar. 24, 2014 (JP) ..... 2014-060911
Mar. 24, 2014 (JP) ..... 2014-060913
Jan. 20, 2015 (JP) ..... 2015-008460

(51) Int. Cl.
*B41J 32/00* (2006.01)
*B41J 3/407* (2006.01)
*B41J 15/04* (2006.01)

(52) U.S. Cl.
CPC ..... *B41J 32/00* (2013.01); *B41J 3/4075* (2013.01); *B41J 15/044* (2013.01)

(58) Field of Classification Search
CPC ..... B41J 2/305; B41J 3/382; B41J 3/4075; B41J 15/044
See application file for complete search history.

(56) References Cited

U.S. PATENT DOCUMENTS 5,653,542 A * 8/1997 Sugimoto ..... B26D 5/00 400/207
5,921,688 A 7/1999 Furuya et al.
2006/0233582 A1* 10/2006 Horiuchi ..... B41J 15/044 400/208
2013/0114988 A1 5/2013 Sodeyama

FOREIGN PATENT DOCUMENTS

JP H07-314868 A 12/1995
JP H09-277678 A 10/1997
JP 2012-020543 A 2/2012
WO WO-2012-008126 A 1/2012

OTHER PUBLICATIONS

International Search Report, Jun. 16, 2015, issued in related Patent Application No. PCT/JP2015/058314.

* cited by examiner

*Primary Examiner* — Manish S Shah
*Assistant Examiner* — Renee I Wilson
(74) *Attorney, Agent, or Firm* — ALG Intellectual Property, LLC

(57) ABSTRACT

A tape cartridge includes a printing tape, an ink ribbon, a platen roller that receives power from a tape feeding mechanism portion and faces a printing head portion so that the printing tape and the ink ribbon are provided between a platen roller and a printing head at a printing position, a cartridge casing that accommodates the printing tape, the ink ribbon, and the platen roller, an insertion opening that is provided on the cartridge casing and in which a head cover is inserted when the tape cartridge is installed on the cartridge installation portion, and a facing portion that is provided on an opening peripheral wall portion of the insertion opening and receives a convex portion to restrict a displacement of the tape cartridge in the cartridge installation portion.

13 Claims, 17 Drawing Sheets

TAPE CARTRIDGE

CROSS REFERENCE TO RELATED APPLICATION

This application is a continuation of PCT application No. PCT/JP2015/058314, which was filed on Mar. 19, 2015 based on Japanese Patent Applications Nos. 2014-060911 filed on Mar. 24, 2014, 2015-008460 filed on Jan. 20, 2015, and 2014-060913 filed on Mar. 24, 2014, the contents of which are incorporated herein by reference.

BACKGROUND

1. Technical Field

The present invention relates to a tape cartridge installed on the cartridge installation portion of a tape printing apparatus to be used and, in particular, to a tape cartridge on which a printing tape and an ink ribbon are mounted.

2. Background Art

As such a tape cartridge and a tape printing apparatus using the tape cartridge, the following tape cartridge and tape printing apparatus have been known (see JP-A-2012-20543).

The tape cartridge includes a tape body in which a printing tape is wound on a tape core, a ribbon body in which an ink ribbon is wound on a ribbon winding-up core, a ribbon winding-up core that winds up the ink ribbon that has been consumed, a platen roller that feeds out and supplies the printing tape from the tape body, and a cartridge casing in which the tape body, the ribbon body, the ribbon winding-up core, and the platen roller are accommodated.

On the other hand, on the bottom plate of the cartridge installation portion of the tape printing apparatus, a positioning projection that positions the tape core, a printing head covered with a head cover, a platen driving shaft that rotates the platen roller, and a ribbon winding-up driving shaft that winds up the ink ribbon via the ribbon winding-up core are provided. In addition, in the lower side space of the cartridge installation portion, a motor-driven tape feeding mechanism that rotates the platen driving shaft and the ribbon winding-up driving shaft is embedded.

Meanwhile, when the tape cartridge is installed on such a cartridge installation portion, the head cover naturally functions as an initial installation guide. While, if the head cover is provided with a rib for reinforcing the head cover, it is required to increase the insertion opening of the tape cartridge so as to correspond to the size of the projecting rib without spoiling the guiding function. However, the increase in the opening projection causes the gap between the head cover and the insertion opening, whereby dust or the like may easily intrude into the vicinity of the printing head or the platen roller.

In such a known tape cartridge, a rotation force is applied from the platen driving shaft to the platen roller to feed the printing tape and the ink ribbon when the tape cartridge is installed on the cartridge installation portion. Similarly, a rotation force is applied from the ribbon winding-up driving shaft to the ribbon winding-up core to wind up the ink ribbon. Some of the rotation force input to the platen roller is applied as a rotation moment to the cartridge casing via a bearing portion by the friction between the platen roller and the bearing portion. Similarly, some of the rotation force input to the ribbon winding-up core is also applied to the cartridge casing as a rotation moment.

In this case, the platen roller rotates clockwise when seen in plan view, and the ribbon winding-up core rotates counterclockwise when seen in plan view. Thus, the resultant force of the rotation moment on the side of the platen roller and the rotation moment on the side of the ribbon winding-up core is applied to the tape cartridge. Since the rotation forces have no vector components that cancel each other on an imaginary line connecting the platen roller and the ribbon winding-up core together, they are overlapped with each other in a direction crossing the imaginary line, whereby the resultant force is applied as the largest force. For this reason, there is a likelihood that the position of the tape cartridge is deviated inside the cartridge installation portion when the tape printing apparatus is driven to perform printing. Further, the positional deviation of the tape cartridge results in the positional deviation of the tape cartridge with respect to the printing head, which gives an adverse affect on printing quality.

The present invention has an object of providing a tape cartridge that can reduce the intrusion of dust without spoiling an installation guiding function with respect to a cartridge installation portion and prevent its positional deviation inside a cartridge installation portion.

SUMMARY OF THE INVENTION

According to the present invention, there is provided a tape cartridge detachably installed in a tape printing apparatus having a cartridge installation portion on which the tape cartridge is installed, a tape feeding mechanism portion that feeds a printing tape from the installed tape cartridge, a ribbon feeding mechanism portion that feeds an ink ribbon in synchronization with the feeding of the printing tape, a printing head portion that performs printing on the printing tape and is configured to be movable between a printing position and a retracting position, a head cover provided on the cartridge installation portion, and a convex portion that projects from an outside surface of the head cover and guides installation of the tape cartridge. The tape cartridge includes the printing tape, the ink ribbon, a platen roller that receives power from the tape feeding mechanism portion and faces the printing head portion so that the printing tape and the ink ribbon are disposed between the platen roller and the printing head at the printing position, a cartridge casing that accommodates the printing tape, the ink ribbon, and the platen roller, an insertion opening that is provided on the cartridge casing and in which the head cover is inserted when the tape cartridge is installed on the cartridge installation portion, and a facing portion that is provided on an opening peripheral wall portion of the insertion opening and receives the convex portion to restrict a displacement of the tape cartridge in the cartridge installation portion.

In this case, the facing portion is preferably a concave portion.

In addition, in this case, the head cover preferably includes three covering side walls having the first covering side wall covering a rear surface side of the printing head portion and the two second covering side walls, respectively, extending from both outside ends of the first covering side wall, the opening peripheral wall portion of the insertion opening preferably includes three opening inside walls having a first opening inside wall corresponding to a first covering side wall and two second opening inside walls corresponding to two second covering side walls, and the three opening inside walls are preferably formed in shapes complementary to the three covering side walls when seen from an installation direction in which the tape cartridge is installed in the tape printing apparatus.

According to these configurations, the insertion opening is guided by the head cover and installed in its appropriate installation position when the tape cartridge is installed on the cartridge installation portion. The opening peripheral wall portion of the insertion opening is provided with the facing portion (concave portion) that receives the convex portion of the head cover. Therefore, the installation is smoothly performed without increasing the size of the opening peripheral wall portion. Thus, it is not required to provide a large gap between the three covering side walls of the head cover and the three opening inside walls of the insertion opening. Accordingly, the intrusion of dust or a positional deviation can be reduced without spoiling the function of guiding the installation on the cartridge installation portion.

In this case, the concave portion preferably relatively fits in the convex portion.

According to this configuration, the concave portion of the insertion opening relatively fits in the convex portion of the head cover when the tape cartridge is installed on the cartridge installation portion. Therefore, the cartridge casing is positioned by the head cover via the insertion opening. That is, the insertion opening, more specifically, the platen roller can be accurately positioned with respect to the printing head portion covered with the head cover.

In addition, the concave portion is preferably provided on the first opening inside wall so as to correspond to the convex portion projecting from an outside surface of the first covering side wall extending in the same direction as the feeding direction of the printing tape.

Meanwhile, when the platen roller provided in the cartridge casing is pressed by the movement of the printing head portion, a pressing force is applied to the cartridge casing via the platen roller.

According to this configuration, the concave portion of the first opening inside wall is positioned by the convex portion of the first covering side wall positioned on the rear surface side of the printing head portion. Therefore, the pressing force of the printing head portion is received by the convex portion via the concave portion. That is, the pressing force of the printing head portion is absorbed by the head cover covering the printing head portion. Therefore, a positional deviation due to the pressing force does not occur in the cartridge casing. Accordingly, printing quality can be secured.

Moreover, the concave portion is preferably provided on each of the two second opening inside walls with respect to the convex portion projecting from each of outside surfaces of the two second covering side walls.

Meanwhile, when the platen roller starts rotating (tape feeding) with the printing tape and the ink ribbon held between the platen roller and the printing head, a rotation force in the vicinity of the platen roller is applied to the cartridge casing.

According to this configuration, the concave portions of the second opening inside walls are positioned by the convex portions of the two second covering side walls. The rotation force in the vicinity of the platen roller is received by the two distant convex portions via the two concave portions. That is, since the rotation force in the vicinity of the platen roller is reduced by the head cover, a positional deviation occurring in the cartridge casing due to the rotation force is reduced. Accordingly, printing quality can be secured.

On the other hand, the concave portion preferably includes two concave-portion side wall surfaces, and the tape cartridge is preferably positioned by the two concave-portion side wall surfaces and the convex portion in a direction crossing a direction in which the convex portion projects.

In addition, the concave portion preferably includes a concave-portion bottom wall surface, and the concave-portion bottom wall surface preferably includes a slant surface ascending in the installation direction.

According to these configurations, the positioning accuracy of the facing portion in the concaved direction thereof and a direction crossing the concaved direction with respect to the convex portion is improved. Accordingly, the insertion opening of the cartridge casing can be positioned so as not to move with respect to the head cover.

In addition, with respect to the convex portion extending from an installation base surface of the cartridge installation portion to a position close to an end position of a feeding path of the ink ribbon on a front side in the installation direction, the concave portion preferably extends from an end surface of the three opening inside on the front side in the installation direction to the position close to the end position.

According to this configuration, the tape cartridge is installed on the cartridge installation portion so as to butt against the installation base. Thus, the positioning accuracy of the insertion opening, more specifically, the positioning accuracy of the platen roller with respect to the printing head portion can be improved. Accordingly, high printing quality can be maintained.

In this case, the three opening inside walls preferably include an inside wall main body and a corner portion at which the inside wall main body and a casing wall on a side of the installation base surface cross each other, and the concave portion is preferably constituted of a concave groove on the corner portion and an opening on the inside wall main body.

According to this configuration, the concave portion is constituted of the concave groove on the corner portion and the opening of the inside wall main body. Therefore, a projecting portion such as a projection is not formed on the inside wall main body. Accordingly, the concave portion can be effectively prevented from interfering with components inside the cartridge casing, the printing tape, or the feeding path of the ink ribbon.

In addition, the cartridge casing preferably includes two casings separable in the installation direction, and the concave portion is preferably provided on one of the casings positioned closer to a front side in the installation direction.

According to this configuration, even if the convex portion is provided on the head cover of the cartridge installation portion, it can be received only by modifying the design of one of the casings.

According to another aspect of the present invention, there is provided a tape cartridge detachably installed on a cartridge installation portion of a tape printing apparatus, the cartridge installation portion on which the tape cartridge having a printing tape and an ink ribbon are installed being provided with a first output portion that outputs forward rotation power to feed the printing tape, a second output portion that outputs reverse rotation power to wind up the ink ribbon, and a main-body-side contact portion that is allowed to come in contact with the tape cartridge when the tape cartridge is installed. The tape cartridge includes, when being installed on the cartridge installation portion, a first input portion to which the forward rotation power is input from the first output portion of the tape printing apparatus; a second input portion to which the reverse rotation power is input from the second output portion of the tape printing apparatus; and a cartridge-side contact portion that is allowed to come in contact with the main-body-side contact portion of the tape printing apparatus, the cartridge-side contact portion existing on an imaginary line connecting the first output portion and the second output portion together or existing near the imaginary line and so as to resist rotation forces generated in the tape cartridge by rotation forces of the first output portion and the second output portion of the tape printing apparatus.

According to this configuration, the cartridge-side contact portion is allowed to come in contact with the main-body-side contact portion so as to resist the rotation forces generated by the first output portion and the second output portion. Accordingly, forces resulting from the rotation forces of the first output portion and the second output portion cause the cartridge-side contact portion and the main-body-side contact portion of the cartridge installation portion to strongly come in contact with each other to secure the positional relationship between the cartridge-side contact portion and the main-body-side contact portion. In addition, since the cartridge-side contact portion exists on the imaginary line (including its vicinity) connecting the first output portion and the second output portion together or exists near the imaginary line, the respective rotation forces of the first output portion and the second output portion have no vector components that cancel each other on or near the imaginary line and thus become maximum. Accordingly, by the use of the rotation forces causing a positional deviation, the positional deviation of the tape cartridge inside the cartridge installation portion can be reduced.

In this case, the first input portion is preferably included in a platen roller configured to be rotatable, and the second input portion is preferably included in a winding-up core configured to be rotatable.

In addition, the tape cartridge preferably further includes an insertion opening that allows the head cover to be inserted in the insertion opening with respect to the cartridge installation portion on which a printing head portion and the head cover having a plurality of edge portions are provided and the main-body-side contact portion projects from one of the edge portions of the head cover, and the cartridge-side contact portion is preferably recessed on an opening peripheral wall portion defining the insertion opening.

According to this configuration, a positional deviation in a direction crossing the concave portion and the convex portion can be further reliably reduced by the engagement between the concave portion and the convex portion.

In this case, with respect to the head cover that covers a side of a rotation supporting shaft of the printing head portion, includes a first covering side wall and a second covering side wall crossing each other, and has the main-body-side contact portion projecting from the edge portion at which the first covering side wall and the second covering side wall cross each other, the opening peripheral wall portion preferably includes a first opening inside wall corresponding to the first covering side wall and a second opening inside wall crossing the first opening inside and corresponding to the second covering side wall, and the cartridge-side contact portion is preferably recessed at a corner portion at which the first opening inside wall and the second opening inside wall cross each other.

According to this configuration, the cartridge-side contact portion is recessed at the corner portion between the first opening inside wall and the second opening inside wall of the opening peripheral wall portion. Therefore, even if the cartridge-side contact portion is recessed on the opening peripheral wall portion, the strength of the opening peripheral wall portion is not lost.

In this case, the cartridge-side contact portion preferably receives the main-body-side contact portion.

According to this configuration, the tape cartridge can be positioned at the cartridge installation portion having the main-body-side contact portion via the cartridge-side contact portion. That is, even if a force other than the rotation moments described above is applied, a positional deviation inside the cartridge installation portion can be prevented.

In addition, with respect to the main-body-side contact portion including a first convex portion projecting from the first covering side wall and a second convex portion projecting from the second covering side wall at the edge portion, the cartridge-side contact portion preferably includes a first concave portion recessed on the first opening inside wall so as to correspond to the first convex portion and a second concave portion recessed on the second opening inside wall so as to correspond to the second convex portion.

According to this configuration, the tape cartridge can be positioned at the cartridge installation portion via the first concave portion and the second concave portion. That is, even if a force other than the rotation moments described above is applied, a positional deviation inside the cartridge installation portion can be prevented.

On the other hand, the cartridge-side contact portion is preferably formed in a shape expanding toward an installation direction to the cartridge installation portion.

According to this configuration, since the cartridge-side contact portion is guided to the cartridge installation portion along the main-body-side contact portion for the installation of the tape cartridge, the tape cartridge can be accurately positioned at the cartridge installation portion.

In addition, the corner portion preferably serves as the cartridge-side contact portion instead of the cartridge-side contact portion recessed at the corner portion.

According to this configuration, the cartridge-side contact portion is not necessarily recessed at the corner portion between the first opening inside wall and the second opening inside wall, and the corner portion itself can constitute the cartridge-side contact portion. Accordingly, the structure in the vicinity of the corner portion can be simplified.

Moreover, the tape cartridge preferably further includes an insertion opening that allows the head cover to be inserted in the insertion openings with respect to the cartridge installation portion on which a printing head portion and a head cover are provided and the main-body-side contact portion projects from the head cover, and the cartridge-side contact portion is preferably a portion facing the main-body-side contact portion of an opening peripheral wall portion defining the insertion opening.

According to this configuration, the cartridge-side contact portion may not be necessarily recessed. Instead, the opening peripheral wall portion can constitute the cartridge-side contact portion. Accordingly, the structure of the opening peripheral wall portion can be simplified. In addition, if an external force is small in a direction crossing a direction in which the cartridge-side contact portion and the main-body-side contact portion come in contact with each other, a positional deviation can be substantially prevented by this configuration.

DETAILED DESCRIPTION OF THE EMBODIMENTS

Hereinafter, with reference to the accompanying drawings, a description will be given of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
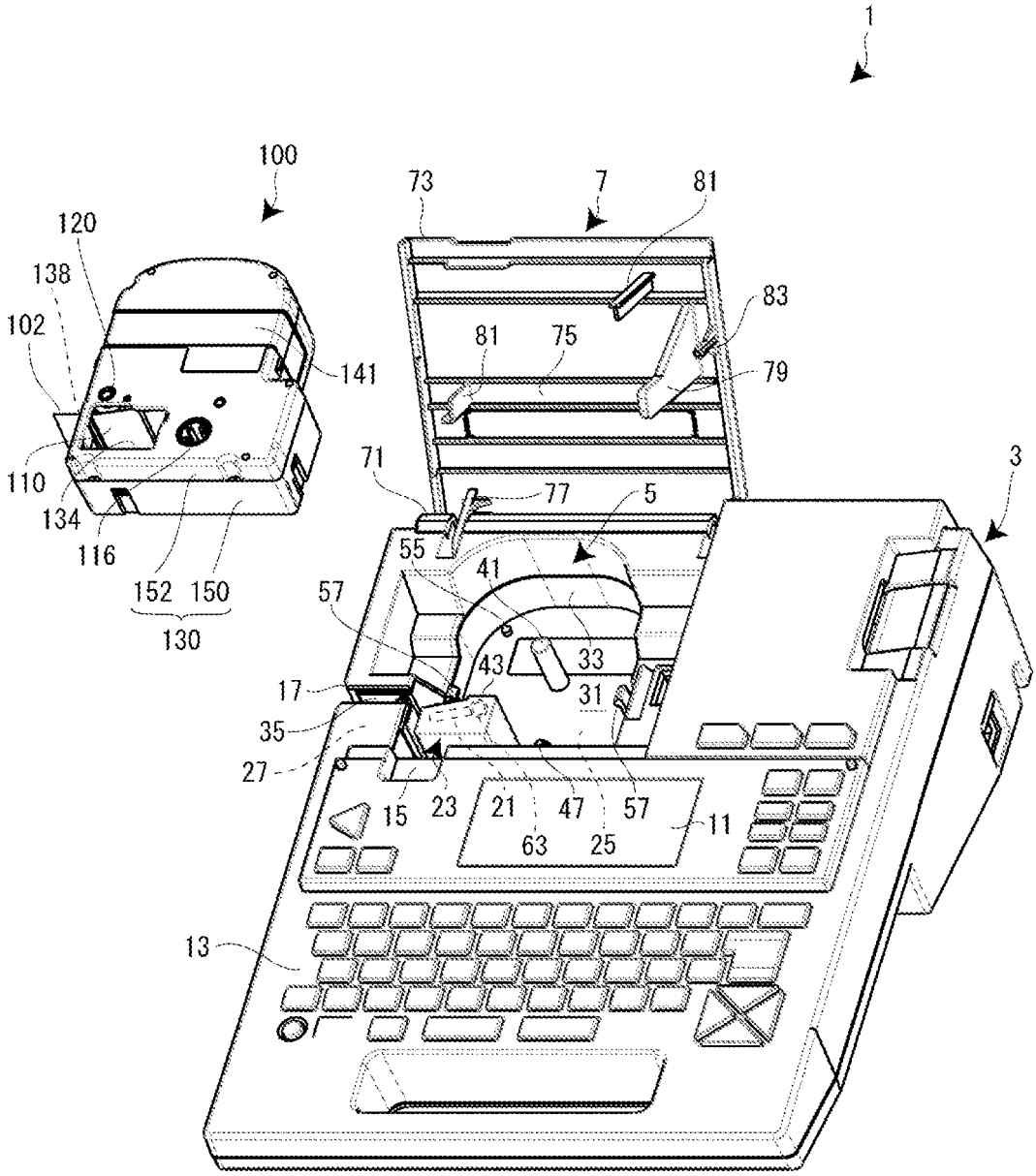
FIG. 1 is an external perspective view of a tape printing apparatus according to an embodiment with its cover opened.

FIG. 1 is an external perspective view of the tape printing apparatus and the tape cartridge installed in the tape printing apparatus. As shown in the figure, a tape printing apparatus 1 includes an apparatus casing 3 constituting an outer shell, a cartridge installation portion 5 on which a tape cartridge 100 is detachably installed, and an opening/closing cover 7 that opens/closes the cartridge installation portion 5. On the upper surface of the apparatus casing 3, the cartridge installation portion 5 is provided on the back side, a display 11 is provided on the central side, and a keyboard 13 is provided on the near side. In the vicinity of the opening/closing cover 7, a finger-hooking recessed portion 15 is provided. The opening/closing cover 7 is opened when the recessed portion 15 is hooked and raised by a finger. Further, on the side surface (left side surface) of the apparatus casing 3, an elongated tape ejection port 17 is provided to eject a printing tape 102.

In addition, the tape printing apparatus 1 includes a printing mechanism portion 23 having a printing head 21 provided to stand on the cartridge installation portion 5, a tape feeding mechanism portion 25 embedded in the back side space of the cartridge installation portion 5, and a tape cutting mechanism portion 27 embedded in the vicinity of the tape election port 17. A user enters printing information via the keyboard 13 and performs printing with a key operation after confirming the printing information on the display 11. Upon the printing instruction, the tape feeding mechanism portion 25 is driven to make the printing tape 102 and the ink ribbon 110 run parallel to each other. Moreover, by heat applied from the printing mechanism portion 23 to the ink ribbon 110, the ink of the ink ribbon 110 is transferred to the printing tape 102 to perform the printing. By the print feeding, the printing tape 102 is ejected from the tape ejection port 17. When the printing is completed, the tape cutting mechanism portion 27 is driven to cut off a printed part of the printing tape 102.

[Outline of Tape Cartridge]

As shown in FIGS. 2A and 2B and FIGS. 5A and 5B, the tape cartridge 100 includes a tape roll 106 in which the printing tape 102 is wound on a tape core 104 and a ribbon roll 114 in which the ink ribbon 110 is wound on a feeding-out core 112. In addition, the tape cartridge 100 includes a winding-up core 116 that winds up the ink ribbon 110 that has been consumed and a platen roller 120 (platen) that comes in contact with the printing head 21 via the ink ribbon 110 and the printing tape 102 and feeds the printing tape 102 and the ink ribbon 110. Moreover, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Further, the tape cartridge 100 includes an insertion opening 134, which receives the printing head 21 when the tape cartridge 100 is installed in the tape printing apparatus 1, on the cartridge casing 130. Furthermore, the tape cartridge 100 includes a tape delivering port 138 that is provided on the cartridge casing 130 and from which the printing tape 102 is delivered. Note that the insertion opening 134 may be a through hole or a bag hole. In addition, as will be described in detail later, the tape roll 106 is rotatably supported by a cylindrical core shaft 192 projecting inside the cartridge casing 130.

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the tape delivering port 138 to the tape ejection port 17. On the other hand, the ink ribbon 110 goes around the peripheral wall portion of the insertion opening 134 and is wound up by the winding-up core 116. Note that a plurality of types of tape cartridges having a different thickness is available as the tape cartridge 100 according to a tape width of the printing tape 102.

[Details of Tape Printing Apparatus]

Figure 3:
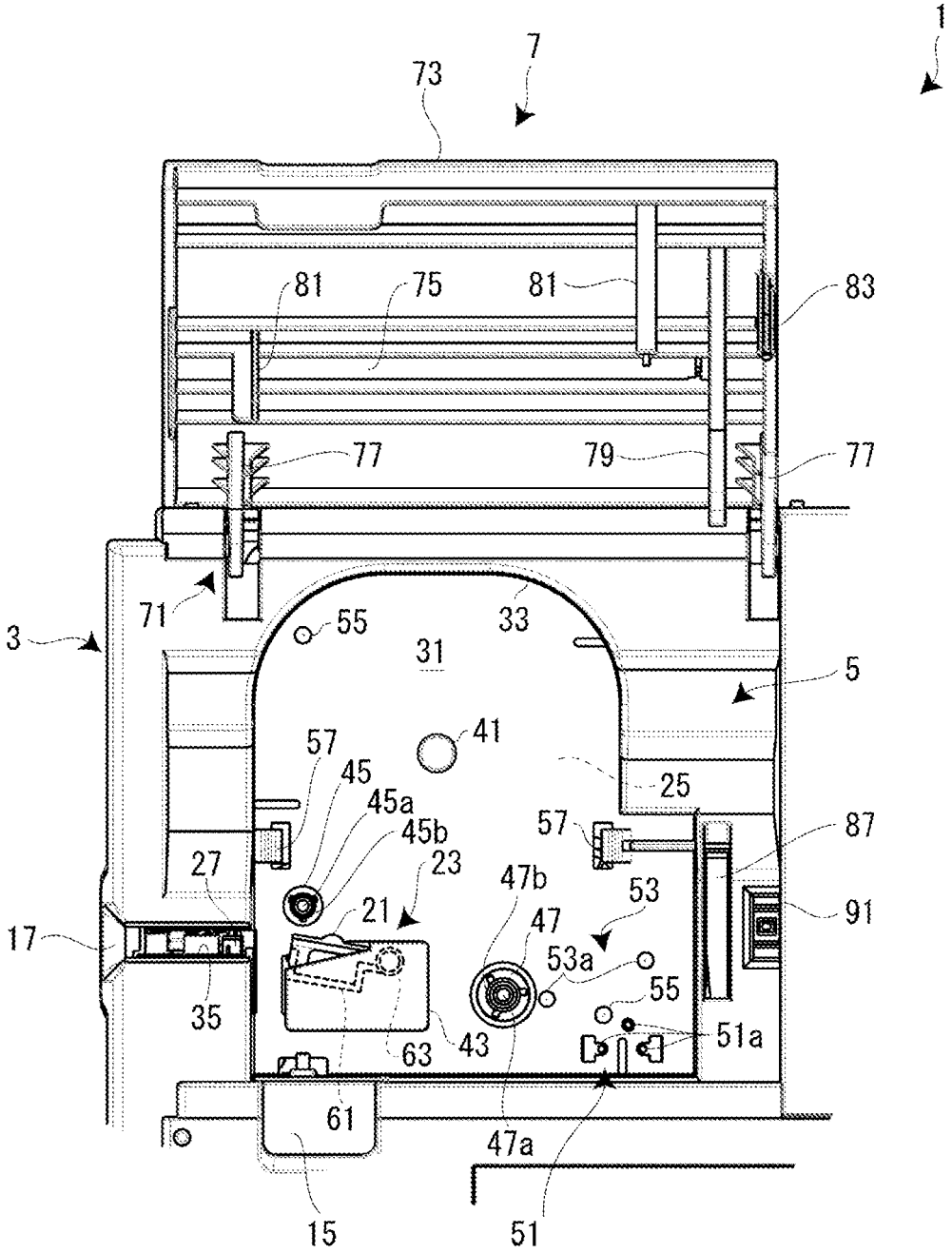
FIG. 3 is a plan view of a cartridge installation portion.

As shown in FIG. 1 and FIG. 3, the cartridge installation portion 5 is formed in a flat shape complementary to the flat shape of the tape cartridge 100 and formed to be recessed with a depth corresponding to the tape cartridge 100 having a maximum thickness among a plurality of types of the installable tape cartridges 100. In this case, an installation base 31 constituting the bottom plate portion of the cartridge installation portion 5 and a side plate portion 33 are integrally formed (molded) by a resin or the like. A slit-shaped tape ejection path 35 is formed between the cartridge installation portion 5 and the tape ejection port 17, and the tape cutting mechanism portion 27 is embedded at this place.

On the installation base 31 of the cartridge installation portion 5, a positioning projection 41 in which the core shaft 192 fits to be positioned and the printing head 21 covered with a head cover 43 are provided to stand. In addition, a platen driving shaft 45 that rotates and drives the platen roller 120 and a winding-up driving shaft 47 that rotates and drives the winding-up core 116 are provided to stand. Moreover, on the installation base 31, a tape detection portion 51 that detects a type (attribute information) of the printing tape 102 and a core releasing portion 53 that releases the rotation-stop of the feeding-out core 112 and the winding-up core 116 are provided in the vicinity of the winding-up driving shaft 47.

Moreover, on the installation base 31, a pair of small projections 55 is provided at the diagonal positions, and a pair of retaining pieces 57 that retain the intermediate portion of the installed tape cartridge 100 is provided. Further, in the back side space of the installation base 31, the tape feeding mechanism portion 25 constituted of a motor, a gear train (each not shown), or the like that rotates the platen driving shaft 45 and the winding-up driving shaft 47 is embedded. The tape feeding mechanism portion 25 branches power with the gear train and causes the platen driving shaft 45 and the winding-up driving shaft 47 to rotate in synchronization with each other.

The printing mechanism portion 23 includes the printing head 21 constituted of a thermal head and a head supporting frame 61 that supports the printing head 21 and rotates the printing head 21 via a rotation supporting shaft 63. In addition, the printing mechanism portion 23 includes a head releasing mechanism (not shown) that rotates the printing head 21 between a printing position and a retracting position via the head supporting frame 61 and the head cover 43 that covers the printing head 21 (and the head supporting frame 61).

The head releasing mechanism operates as the opening/closing cover 7 is opened/closed. The head releasing mechanism moves (rotates) the printing head 21 to the printing position according to the closing operation of the opening/closing cover 7. In addition, the head releasing mechanism moves (rotates) the printing head 21 to the retracting position according to the opening operation thereof. The printing head 21 comes in contact with the platen roller 120 via the ink ribbon 110 and the printing tape 102 when moving to the printing position and separates from the platen roller 120 when moving to the retracting position. Thus, the printing tape 102 and the ink ribbon 110 are prevented from interfering with the printing head 21 when the tape cartridge 100 is attached/detached.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven.

The head cover 43 is formed in a substantially rectangle shape in plan view and integrally formed (molded) with the installation base 31 (the cartridge installation portion 5). In addition, the head cover 43 largely vertically projects from the installation base 31. The head cover 43 internally allows the rotation of the printing head 21 and externally functions as an installation guide for the tape cartridge 100.

The tape detection portion 51 is constituted of a plurality of micro switches 51*a*, selectively engages with a detected portion 180 of the tape cartridge 100 that will be described later, and detects a type such as a tape width, a tape color, and a material of the printing tape 102. Further, based on the detection result, the driving of the printing head 21 and the tape feeding mechanism portion 25 is controlled. The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a fixation shaft 45*a* elongated so as to allow the insertion of the platen roller 120 and a spline-shaped movable shaft 45*b* rotatably journaled in the base portion of the fixation shaft 45*a*. The rotation power of the tape feeding mechanism portion 25 is transmitted to the movable shaft 45*b* and then transmitted from the movable shaft 45*b* to the platen roller 120. Similarly, the winding-up driving shaft 47 includes a fixation shaft 47*a* and a spline-shaped movable shaft 47*b* rotatably journaled in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41, the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

Figure 4:
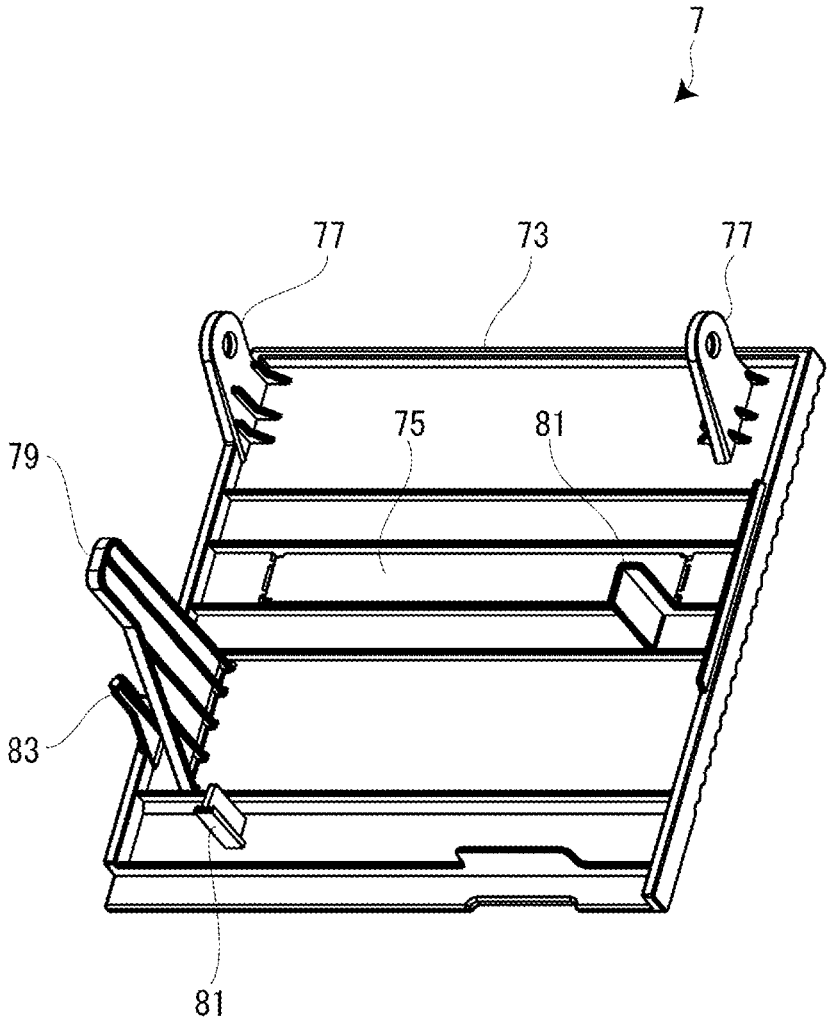
FIG. 4 is a perspective view of the opening/closing cover when seen from the side of its rear surface.

As shown in FIG. 1 and FIG. 4, the opening/closing cover 7 is rotatably, i.e., openably/closably attached to the apparatus casing 3 via a hinge portion 71 provided on the back side. The opening/closing cover 7 includes an opening/closing cover main body 73 formed in a rectangle shape in plan view and a check window 75 provided at the center of the opening/closing cover main body 73. In addition, the opening/closing cover 7 includes a pair of journaled pieces 77 that projects from the rear surface of the opening/closing cover main body 73 and is rotatably journaled in the hinge portion 71 and an operation lever 79 that projects from the rear surface of the opening/closing cover main body 73 and rotates the printing head 21. Moreover, the opening/closing cover 7 includes two pressing projections 81 that project from the rear surface of the opening/closing cover main body 73 and press the tape cartridge 100 and a pressing projection 83 that projects from the rear surface of the opening/closing cover main body 73 and operates (turns ON) an embedded cover closing detection switch (not shown).

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. 10*n* addition, the pair of journaled pieces 77, the operation lever 79, the two pressing projections 81, and the pressing protection 83 are integrally formed (molded) with the opening/closing cover main body 73 by a resin.

The operation lever 79 largely projects from the rear surface of the opening/closing cover main body 73 and is inserted in a slit opening 87 provided on the lateral side of the cartridge installation portion 5 as the opening/closing cover 7 is closed. The operation lever 79 inserted in the slit opening 87 causes the head releasing mechanism described above to operate and the printing head 21 to rotate. Similarly, as the opening/closing cover 7 is closed, the pressing projection 83 is inserted in a rectangle opening 91 adjacent to the slit opening 87 to turn "ON" the cover closing detection switch.

One of the pressing projections 81 is positioned so as to be in the vicinity of the platen roller 120 of the tape cartridge 100, and the other of the processing projections 81 is positioned so as to be right above the tape detection portion 51. When the opening/closing cover 7 is closed, the two pressing projections 81 press the tape cartridge 100 so as to be set on the installation base 31 of the cartridge installation portion 5 and prevent the tape cartridge 100 from floating.

[Details of Tape Cartridge]

Next, a description will be given in detail of the tape cartridge 100 with reference to FIGS. 2A and 2B, FIGS. 5A and 5B, and FIG. 6. Note that in the description of the tape cartridge 100, a surface on the near side in the installation direction, i.e., on the upper front side of the tape cartridge 100 will be called a "front surface," a surface on the back side in the installation direction, i.e., on the opposite side of the tape cartridge 100 will be called a "rear surface," a side surface on the left side of the tape cartridge 100 will be called a "left side surface," a side surface on the right side thereof will be called a "right side surface," an arc-shaped side surface on the upper side thereof will be called a "tip end surface," and a side surface on the lower side thereof will be called a "base end surface" taking FIGS. 2A and 2B as an example.

As described above, the tape cartridge 100 includes the cartridge casing 130 and the tape roll 106, the ribbon 114, the winding-up core 116, and the platen roller 120 accommodated in the cartridge casing 130. In addition, the tape cartridge 100 includes the insertion opening 134 provided on the cartridge casing 130, the tape delivering port 138 formed on the left side surface in the vicinity of the platen roller 120, and an identification label 141 (see FIG. 1) affixed from the left side surface to the right side surface via the front surface at a position at which the tape roll 106 is accommodated. On the identification label 141, a tape width, a tape color, a material, and the like of the printing tape 102 accommodated in the cartridge casing 130 are displayed at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a resin molded item, and the lower casing 150 is constituted of a non-transparent resin molded item.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral portion 158 of the upper casing 152, a plurality of joining pins 170 is provided at appropriate intervals. While, on the lower peripheral wall 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

Figure 2A:
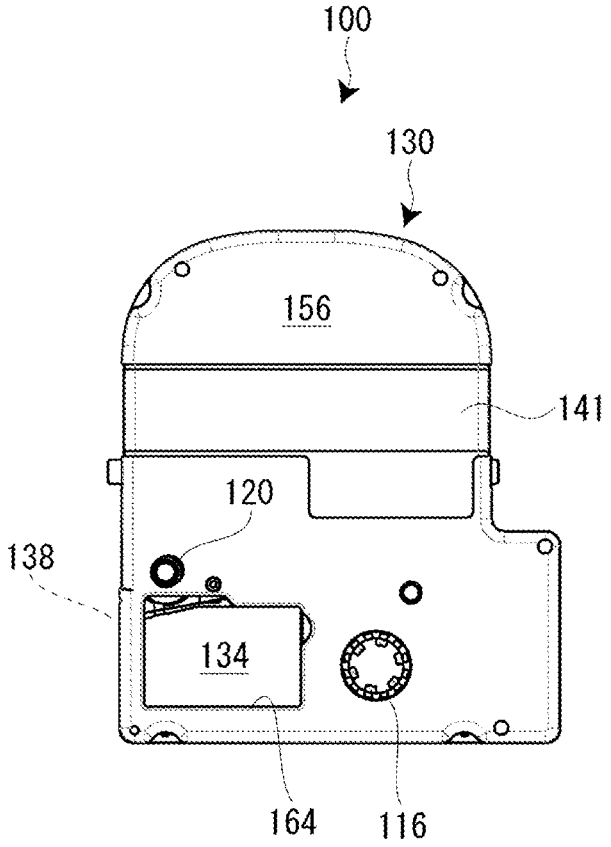
FIGS. 2A and 2B are, respectively, a plan view and a side surface view of a tape cartridge according to the embodiment.
Figure 2B:
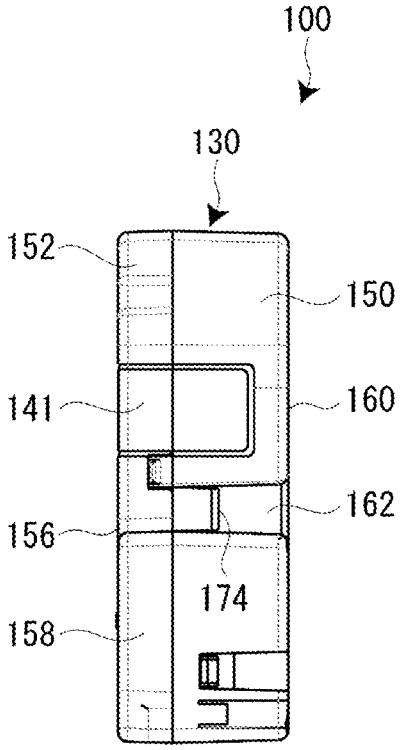
Figure 6:
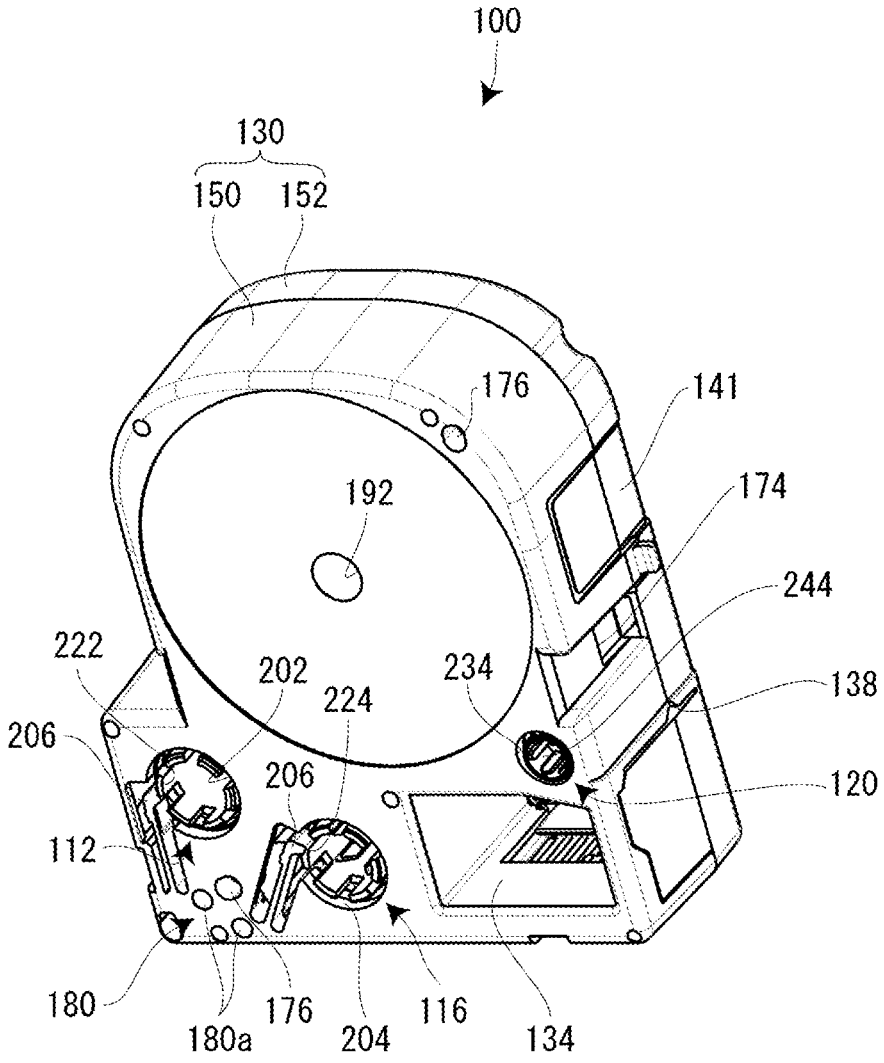
FIG. 6 is a perspective view of the tape cartridge when seen from the side of its rear surface.

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the pair of small fitting holes 176 of the installed tape cartridge 100, the tape cartridge 100 is easily positioned on the installation base 31.

Moreover, on the rear surface of the lower casing 150, the detected portion 180 corresponding to the tape detection portion 51 is provided at a left corner part on the side of the base end surface (i.e., at a right corner part as seen from the side of the front surface) (see FIG. 6). The detected portion 180 is constituted at a place corresponding to the plurality of micro switches 51*a* of the tape detection portion 51, and a plurality of bit patterns is obtained based on the presence or absence of reception les 180*a* provided at the place. That is, the bit patterns correspond to a type of the printing tape 102.

Figure 5A:
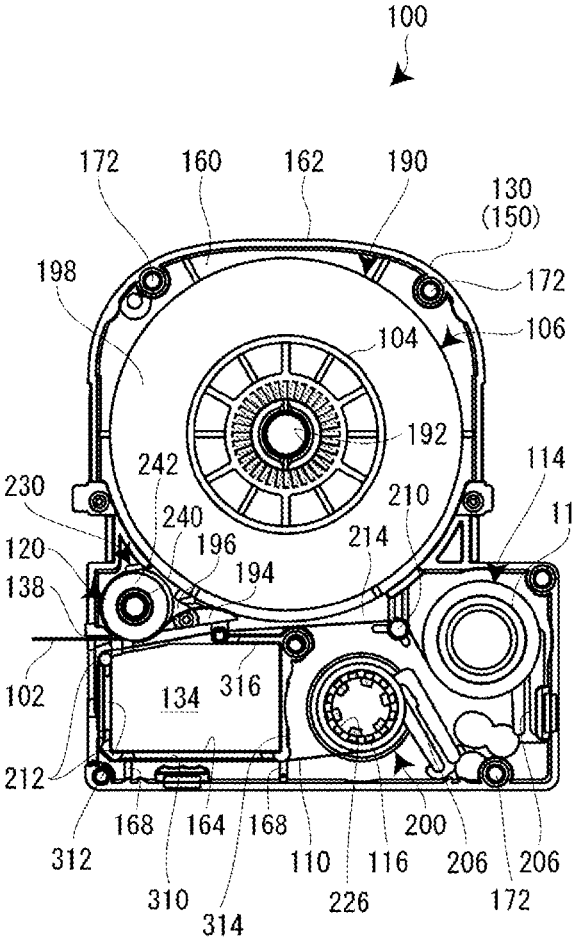
FIGS. 5A and 5B are, respectively, a plan view of the tape cartridge with its upper casing removed and a rear surface view of the upper casing.
Figure 5B:
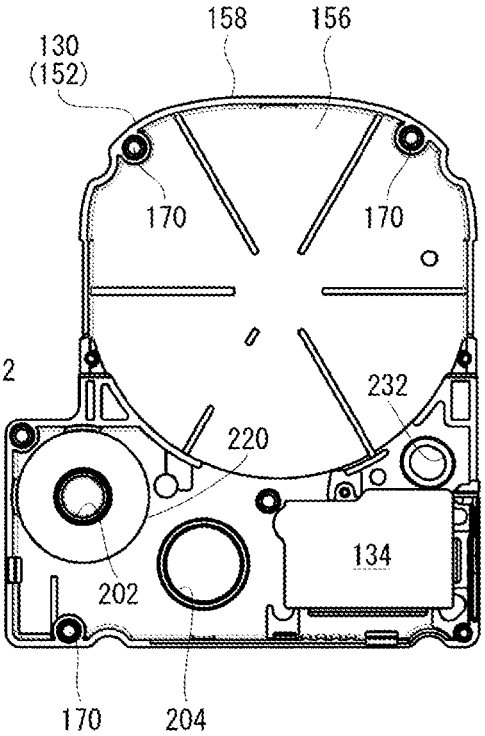

As shown in FIGS. 5A and 5B, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably journaled in the outer peripheral surface of the core shaft 192. In addition, in the tape accommodation area 190, a tape guide 194 that guides the fed-out printing tape 102 to the platen roller 120 is integrally formed with the lower casing 150 so as to stand in the vicinity of the platen roller 120.

That is, inside the cartridge casing 130, a tape feeding path 196 ranging from the tape roll 106 as a starting point to the tape delivering port 138 via the tape guide 194 and the platen roller 120 is constituted. The printing tape 102 fed out from the tape roll 106 is guided to the platen roller 120 via the tape guide 194 and subjected to printing by the platen roller 120. Then, the printing tape 102 is further guided from the platen roller 120 to the tape delivering port 138.

The tape roll 106 includes two circular films 198 affixed to both end surfaces of the roll-shaped printing tape 102, besides the printing tape 102 and the tape core 104. The two circular films 198 prevent the printing tape 102 wound on the tape core 104 from spreading out. In addition, although not shown in the figures, a reverse-rotation stop mechanism is embedded in the tape core 104. When the tape cartridge 100 is carried, the reverse rotation of the printing tape 102 is prevented by the reverse-rotation stop mechanism. On the other hand, when the tape cartridge 100 is installed on the cartridge installation portion 5, the reverse-rotation stop of the reverse-rotation stop mechanism is released by the positioning projection 41, whereby the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 on the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 via the first ribbon guide 210, the platen roller 120, and the plurality of second ribbon guides 212 is constituted. The ink ribbon 110 fed out from the ribbon roll 114 is guided to the platen roller 120 via the first ribbon guide 210 and subjected to printing bv the platen roller 120. Moreover, the ink ribbon 110 goes around the opening peripheral wall portion 164 (the plurality of second ribbon guides 212) via the platen roller 120 and is wound up by the winding-up core 116.

Figure 7A:
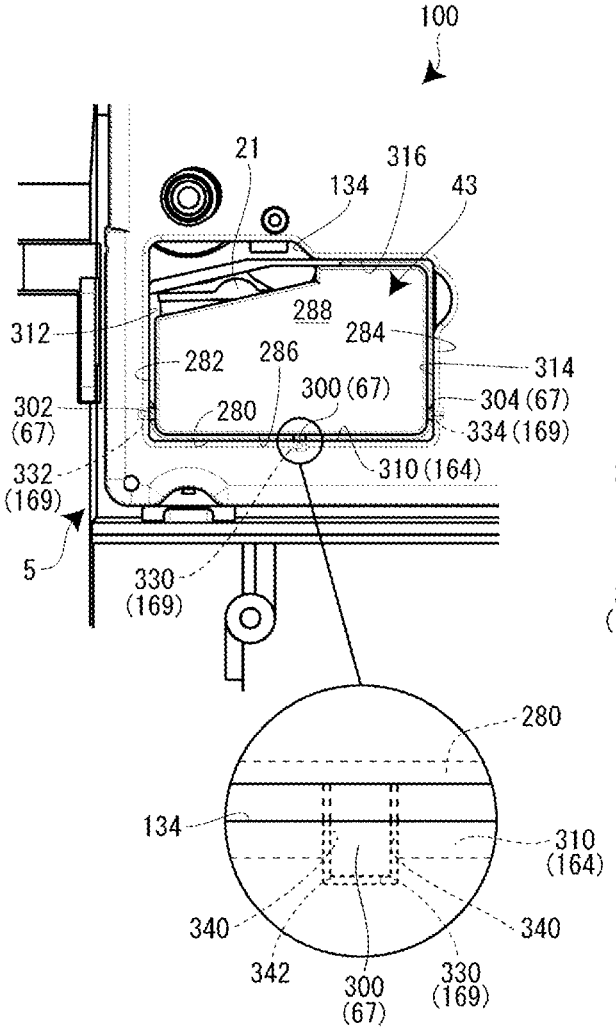
FIGS. 7A and 7B are, respectively, an enlarged plan view and an enlarged cross-sectional view in the vicinity of an insertion opening in a state in which the tape cartridge according to a first embodiment is installed on the cartridge installation portion.
Figure 7B:
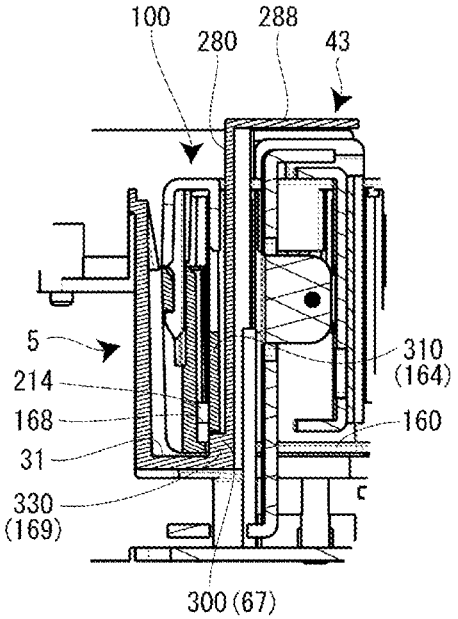

Note that in order to restrict the downward positional deviation of the ink ribbon 110, a plurality of rib-shaped restriction portions 168 is provided on a ribbon feeding path 214 that goes around the opening peripheral wall portion 164 (see FIGS. 7A and 7B). Each of the plurality of rib-shaped restriction portions 168 is provided on the bottom wall portion 160 of the lower casing 150 so as to be formed in a rib shape at the positions of the first ribbon guide 210, the second ribbon guides 212, the corners of the opening peripheral wall portion 164, or the like.

The ribbon roll 114 includes the ink ribbon 110 and the feeding-out core 112. In addition, the ribbon roll 114 includes a circular leaf spring 220 that applies a braking load to the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of the constituents).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical opening formed on the lower casing 150 and an upper bearing portion 232 (see FIG. 5B) having an elliptical opening formed on the upper casing 152 are provided. Further, by the upper bearing portion 232 and the lower bearing portion 234, the platen roller 120 is supported so as to be rotatable and horizontally movable. That is, the platen roller 120 supported by the elliptical upper bearing portion 232 and the lower bearing portion 234 is configured to be horizontally movable (slightly movable) between a home position at which the platen roller 120 engages with the platen driving shaft 45 and a holding position at which the platen roller 120 comes in contact with the tape guide 194 with the printing tape 102 held therebetween.

Meanwhile, when the tape cartridge 100 is carried, the fed-out end of the printing tape 102 is in a state of slightly projecting from the tape delivering port 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 via the tape delivering port 138.

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and spline-engages with the platen driving shaft 45. Thus, the rotation force of the platen driving shaft 45 is transmitted to the platen roller 120 to print-feed the printing tape 102 (and the ink ribbon 110).

[Introduction of First and Second Embodiments]

Meanwhile, as shown in FIGS. 7A and 7B, the insertion opening 134 defined by the opening peripheral wall portion 164 is a portion in which the head cover 43 of the cartridge installation portion 5 is inserted, and the head cover 43 includes three guiding convex portions 67 (convex portions) provided to project to the tape cartridge 100 at the base thereof. On the other hand, the opening peripheral wall portion 164 includes three guiding concave portions 166 (facing portions) corresponding to the three guiding convex portions 67 provided on the head cover 43. When the tape cartridge 100 is installed on the cartridge installation portion 5, the three guiding concave portions 166 of the tape cartridge 100 fit in the three guiding convex portions 67 of the head cover 43, respectively, whereby the tape cartridge 100 is positioned at the cartridge installation portion 5 (that will be described in detail later).

[Guiding Concave Portions and Guiding Convex Portions (First Embodiment)]

Next, with reference to FIGS. 7A and 7B to FIG. 9, a description will be given in detail of the structure of the guiding concave portions 169 of the tape cartridge 100 according to a first embodiment in conjunction with the structure of the guiding convex portions 67 of the head cover 43.

As shown in the enlarged views of FIGS. 7A and 7B and FIGS. 8A and 8B, on the head cover 43 provided to stand on the installation base 31 of the cartridge installation portion 5, the guiding convex portions 67 (convex portions) are provided at three places so as to project toward the outside. The head cover 43 is integrally formed by a rear covering side wall 280 covering the rear surface side of the printing head 21, a left covering side wall 282 and a right covering side wall 284 extending from both outside ends of the rear covering side wall 280 at right angles, and a covering top wall 288 covering the printing head 21 (the printing head portion) from the upper side. The left covering side wall 282 shortly extends from the rear covering side wall 280, and the right covering side wall 284 longly extends from the rear covering side wall 280.

On the installation base 31, the three guiding convex portions 67 include a rear guiding convex portion 300 protecting from the outside surface of the rear covering side wall 280, a left guiding convex portion 302 projecting from the outside surface of the left covering side wall 282, and a right guiding convex portion 304 projecting from the outside surface of the right covering side wall 284. The rear guiding convex portion 300 is disposed at an intermediate position in the extending direction of the rear covering side wall 280 and formed in a rectangle shape in cross section. The left guiding convex portion 302 is disposed at a position, which is close to the near side of the rear covering side wall 280, of the left covering side wall 282 and formed in a rectangle shape in cross section. Similarly, the right guiding convex portion 304 is disposed at a position, which is close to the rear covering side wall 280, of the right covering side wall 284 and formed in a rectangle shape in cross section.

Figure 8A:
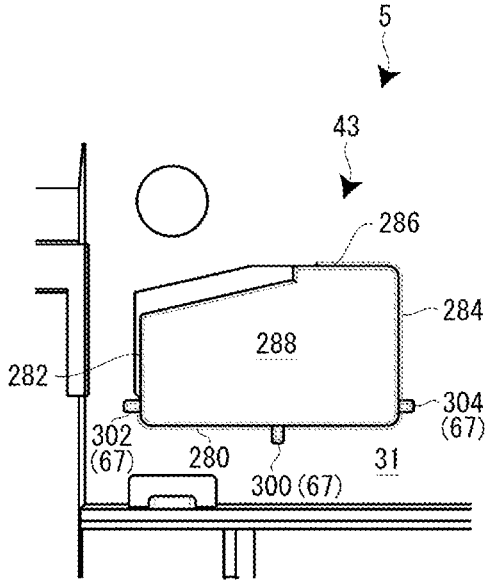
FIGS. 8A and 8B are, respectively, an enlarged plan view and an enlarged side surface view in the vicinity of the head cover of the cartridge installation portion.
Figure 8B:
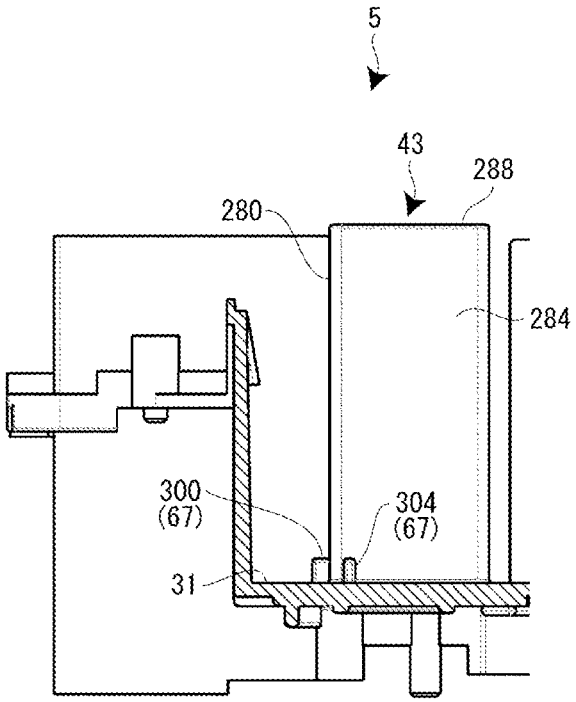

In addition, the rear guiding convex portion 300, the left guiding convex portion 302, and the right guiding convex portion 304 are formed to be the same in height from the installation base 31 and designed to be lower than the rib-shaped restriction portions 168 (see FIG. 7B and FIG. 8B). As will be described in detail later, the guiding concave portions 169 corresponding to the guiding convex portions 67 are designed to be positioned below the rib-shaped restriction portions 168, and the guiding concave portions 169 are designed so as not to project to the ribbon feeding path 214. Further, the rear guiding convex portion 300, the left guiding convex portion 302, and the right guiding convex portion 304 are integrally formed (molded) with the head cover 43 and the installation base 31 and function as installation guides for the head cover 43 and ribs for reinforcing the head cover 43.

Figure 9:
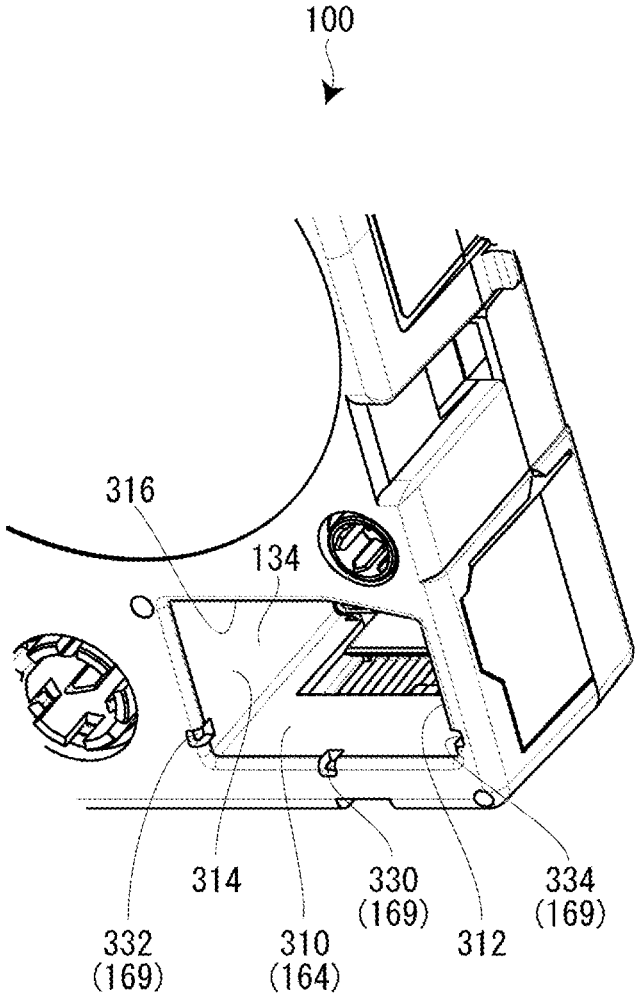
FIG. 9 is an enlarged perspective view in the vicinity of the insertion opening of the tape cartridge according to the first embodiment.

As shown in the enlarged views of FIGS. 7A and 7B and FIG. 9, the three guiding concave portions 169, which receive the three guiding convex portions 67, of the tape cartridge 100 are formed on the opening peripheral wall portion 164 that defines the insertion opening 134. The opening peripheral wall portion 164 includes a rear opening inside wall 310 corresponding to the rear covering side wall 280, a left opening inside wall 312 corresponding to the left covering side wall 282, a right opening inside wall 314 corresponding to the right covering side wall 284, and a front opening inside wall 316 corresponding to the front covering side wall 286. Further, an inside contour (contour seen from the installation direction) constituted of the rear opening inside wall 310, the left opening inside wall 312, and the right opening inside wall 314 and an outside contour (contour seen from the installation direction) constituted of the rear covering side wall 280, the left covering side wall 280, and the right covering side wall 284 are formed in shapes complementary to each other.

The three guiding concave portions 169 include a rear guiding concave portion 330 that is formed on the rear opening inside wall 310 and in which the rear guiding convex portion 300 fits, a left guiding concave portion 332 that is formed on the left opening inside wall 312 and in which the left guiding convex portion 302 fits, and a right guiding concave portion 334 that is formed on the right opening inside wall 314 and in which the right guiding convex portion 304 fits. Further, the rear guiding concave portion 330 is formed in a rectangle shape in cross section, i.e., a shape complementary to the rear guiding convex portion 300 formed in the rectangle shape in cross section. In addition, the left guiding concave portion 332 is formed in a rectangle shape in cross section, i.e., a shape complementary to the left guiding convex portion 302. Similarly, the right guiding concave portion 334 is formed in a rectangle shape in cross section, i.e., a shape complementary to the right guiding convex portion 304.

In this case, each of the rear guiding concave portion 330, the left guiding concave portion 332, and the right guiding concave portion 334 includes two concave-portion side wall surfaces 340 parallel to each other, and the two concave-portion side wall surfaces 340 come in contact with the side surfaces of each of the guiding convex portions 67. Thus, the rear guiding concave portion 330 is positioned in its right-and-left direction (direction orthogonal to the projecting direction) by the rear guiding convex portion 300. Similarly, the left guiding concave portion 332 is positioned in its back-and-forth direction (direction orthogonal to the projecting direction) by the left guiding convex portion 302, and the right guiding concave portion 334 is positioned in its back-and-forth direction (direction orthogonal to the projecting direction) by the right guiding convex portion 304.

In addition, each of the rear guiding concave portion 330, the left guiding concave portion 332, and the right guiding concave portion 334 includes a concave-portion bottom wall surface 342 in the installation direction, the concave-portion bottom wall surface 342 having an ascending slant surface (see FIG. 7B). Thus, when the tape cartridge 100 is installed on the cartridge installation portion 5, the displacement of the rear guiding convex portion 300 in the projecting direction of the rear guiding convex portion 300 is restricted at the rear guiding concave portion 330 by the rear guiding convex portion 300. The pressing force is transmitted to the tape cartridge 100 via, for example, the upper bearing portion 232 and the lower bearing portion 234 to cause the rear guiding concave portion 330 to be displaced toward the rear guiding convex portion 300, but is restricted by the rear guiding convex portion 300. Similarly, the position of the left guiding concave portion 332 is restricted by the left guiding convex portion 302, and the position of the right guiding concave portion 334 is restricted by the right guiding convex portion 304. Thus, the tape cartridge 100 is positioned in the right-and-left direction so as not to move.

On the other hand, the rear guiding concave portion 330, the left guiding concave portion 332, and the right guiding concave portion 334 are formed to be the same in height from the bottom wall portion 160, and their heights are designed to be slightly lower than the rib-shaped restriction portions 168 (see FIG. 7B). Thus, the three guiding concave portions 169 are designed so as not to project to the ribbon feeding path 214.

Further, the rear guiding concave portion 330, the left guiding concave portion 332, and the right guiding concave portion 334 are each actually disposed at a corner portion 350 at which the opening peripheral wall portion 164 and the bottom wall portion 160 cross each other (see FIG. 7B and FIG. 9). The concave portions 330, 332, and 334 are constituted of concave grooves at the corner portion 350 and constituted of openings on the side of the opening peripheral wall portion 164 (an inside wall main body). Thus, the three guiding concave portions 169 can be easily formed without spoiling their function.

As described above, when the tape cartridge 100 is installed on the cartridge installation portion 5, the three guiding concave portions 169 of the tape cartridge 100, respectively, fit in the three guiding convex portions 67 of the head cover 43, whereby the tape cartridge 100 is positioned at the cartridge installation portion 5. Therefore, even if the pressing force of the printing head 21 or the rotation forces (rotation moments) of the platen driving shaft 45 and the winding-up driving shaft 47 is applied to the tape cartridge 100, a positional deviation does not occur in the tape cartridge 100. Accordingly, the positional deviation of the tape cartridge 100 can be reduced. Accordingly, reduction in printing quality due to the positional deviation of the tape cartridge 100 can be prevented.

In addition, since the installation of the tape cartridge 100 is guided by the cooperation between the guiding convex portions 67 and the guiding concave portions 169, the gap between the head cover 43 and the insertion opening 134 can be narrowed to a greater extent and the intrusion of dust or the like from this portion can be effectively prevented.

[Guiding Concave Portions and Guiding Convex Portions (Second Embodiment)]

Figure 10:
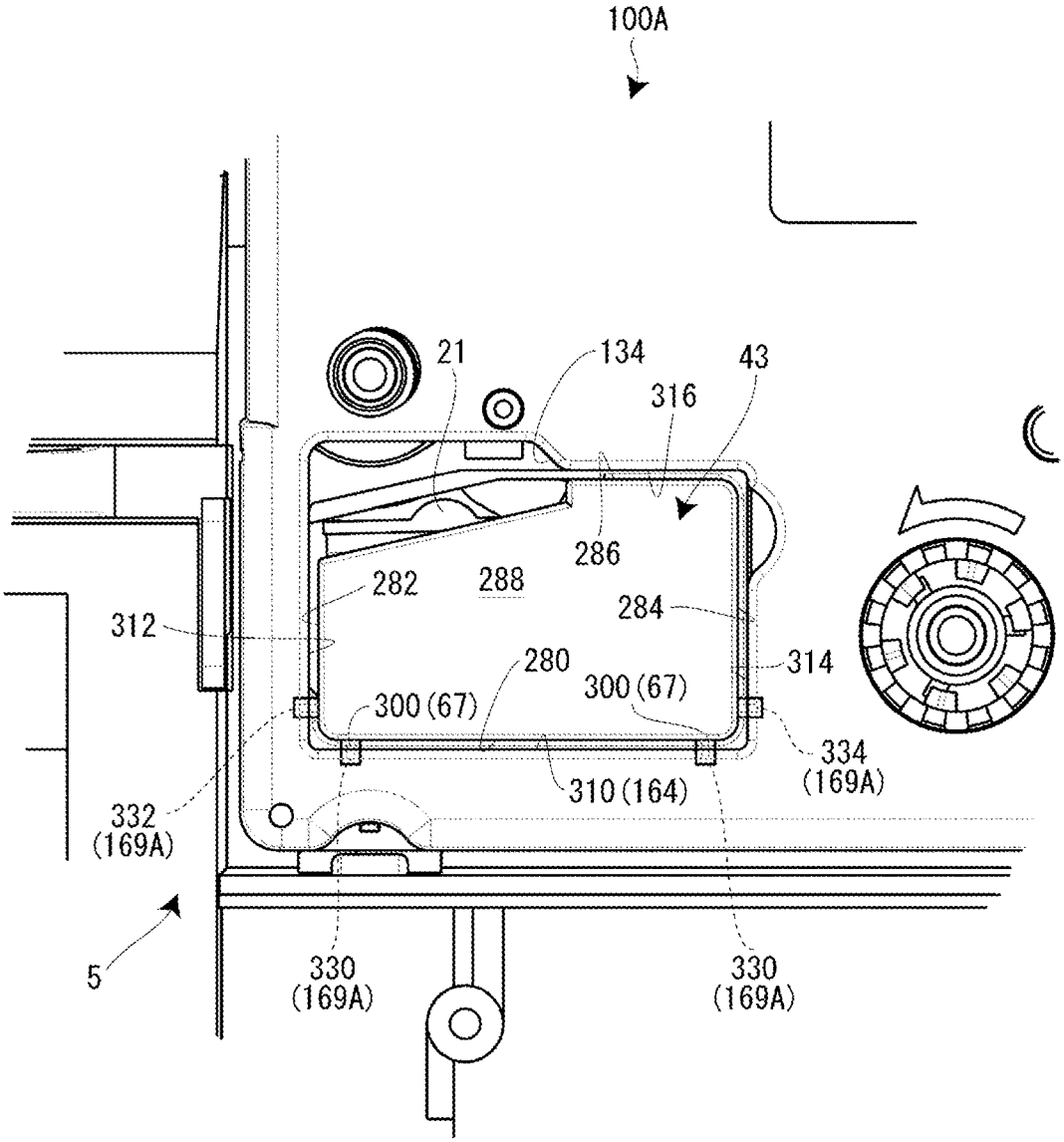
FIG. 10 is an enlarged plan view in the vicinity of an insertion opening when a tape cartridge according to a second embodiment is installed on a cartridge installation portion.

Next, with reference to FIG. 10, a description will be given of the structure of guiding concave portions 169A of a tape cartridge 100A according to a second embodiment in conjunction with the structure of guiding convex portions 67 of a head cover 43. In addition, portions different from those of the first embodiment will be mainly described in the second embodiment.

As shown in the figure, in this embodiment, the four guiding convex portions 67 are provided on the head cover 43, and the four guiding concave portions 169A are provided on an opening peripheral wall portion 164 of the tape cartridge 100A so as to correspond to the four guiding convex portions 67.

The four guiding convex portions 67 include two rear guiding convex portions 300 projecting from the outside surface of a rear covering side wall 280, a left guiding convex portion 302 projecting from the outside surface of a left covering side wall 282, and a right guiding convex portion 304 projecting from the outside surface of a right covering side wall 284. One of the rear guiding convex portions 300 and the left guiding convex portion 302 are disposed in the vicinity of the corner between the rear covering side wall 280 and the left covering side wall 282, and the other of the rear guiding convex portions 300 and the right guiding convex portion 304 are disposed in the vicinity of the corner between the rear covering side wall 280 and the right covering side wall 284.

In order to correspond to the four guiding convex portions 67, the four guiding concave portions 169A include two rear guiding concave portions 330 that are formed on a rear opening inside wall 310 and in which the two rear guiding convex portions 300 fit, a left guiding concave portion 332 that is formed on a left opening inside wall 312 and in which the left guiding convex portion 302 fits, and a right guiding concave portion 334 that is formed on a right opening inside wall 314 and in which the right guiding convex portion 304 fits.

As described above, at one of the two corners of the opening peripheral wall portion 164 (on the left side), one of the rear guiding concave portions 330 fits in one of the rear guiding convex portions 300, and the left guiding concave portion 332 fits in the left guiding convex portion 302. In addition, at the other corner (on the right side), the other of the rear guiding concave portions 330 fits in the other of the rear guiding convex portions 300, and the right guiding concave portion 334 fits in the right guiding convex portion 304. Thus, the two corners of the opening peripheral wall portion 164 are positioned in both the back-and-forth and the right-and-left directions. That is, the tape cartridge 100A is positioned in both the back-and-forth and the right-and-left directions at the two distant places in the vicinity of the printing head 21.

In the second embodiment as well, when the tape cartridge 100A is installed on the cartridge installation portion 5, the four guiding concave portions 169A of the tape cartridge 100A fit in the four guiding convex portions 67 of the head cover 43, respectively, whereby the tape cartridge 100A is positioned at the cartridge installation portion 5 so as not to move. Therefore, even if an external force is applied to the tape cartridge 100A, the positional deviation of the tape cartridge 100 is prevented. As a result, reduction in printing quality due to the positional deviation of the tape cartridge 100A can be effectively prevented.

Note that in the first and second embodiments, the numbers of the guiding convex portions 67 and the guiding concave portions 169 are arbitrarily. In addition, the lengths of the guiding convex portions 67 and the guiding concave portions 169 are also arbitrarily. For example, some or all of the guiding convex portions 67 and the guiding concave portions 169 may be, respectively, the guiding convex portions 67 same in length same as the height of the head cover 43 and the guiding concave portions 169 same in length as the height of the opening peripheral wall portion 164. In addition, instead of the guiding concave portions 169, the rear opening inside wall 312 and the second inside wall 330 of the insertion opening 134 may be formed in shapes entirely retracted to the bottom portions of the guiding concave portions 169A of the first and second embodiments. With this shapes, the same effects as those of the first and second embodiments described above can be obtained in a case in which a main positional deviation occurs in a direction crossing the inside walls. Accordingly, since the shape of the insertion opening 134 can be simplified, the manufacturing of the tape cartridge 100 and 100A is facilitated and the tape cartridges 100 and 100A can be smoothly installed without getting snagged.

[Introduction of Third to Fifth Embodiments]

Meanwhile, in the tape cartridge 100 of the embodiment, a rotation force is input from the platen driving shaft 45 to the platen roller 120, while a rotation force is input from the winding-up driving shaft 47 to the winding-up core 116. Thus, a rotation moment is applied to the cartridge casing 130 via the friction of the bearing portion of the platen roller 120, while a rotation moment is applied to the cartridge casing 130 via the friction of the bearing portion of the winding-up core 116. The two rotation moments are mutually applied in opposite directions. In addition, since there are no vector components that cancel each other on an imaginary line L connecting the platen roller 120 and the winding-up core 116 together, their resultant force M is applied in a direction crossing the imaginary line L on the largest scale (see FIG. 11A). Therefore, in the embodiment, the main-body-side contact portion 65 and the cartridge-side contact portion 166 are provided at the head cover 43 and the tape cartridge 100B, respectively, to resist the resultant force M.

Figure 11A:
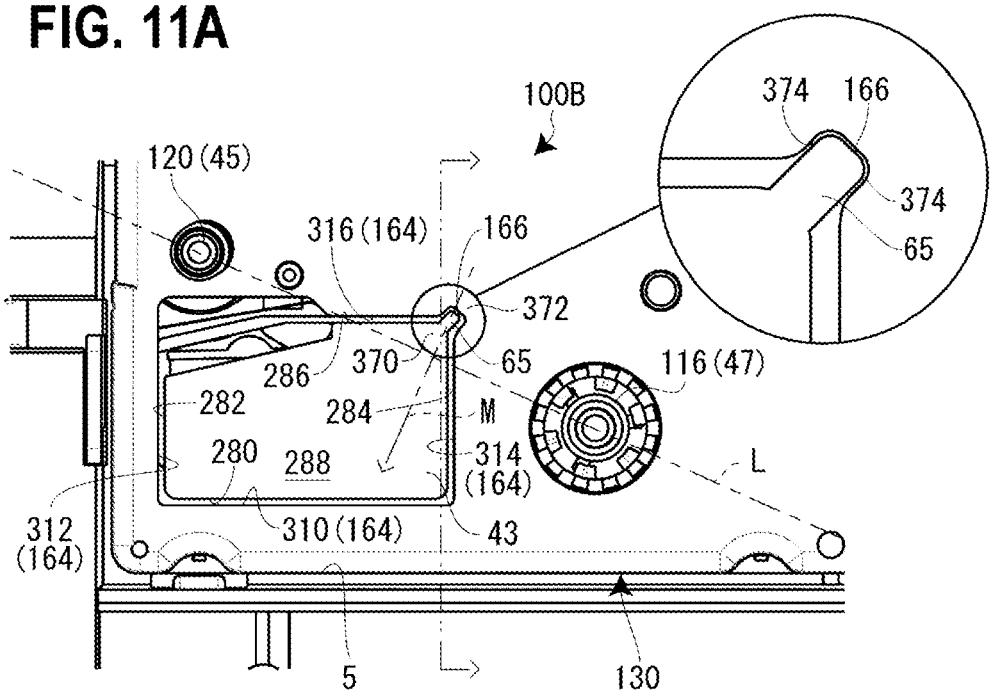
FIGS. 11A and 11B are, respectively, an enlarged plan view and an enlarged cross-sectional view in the vicinity of a cartridge-side contact portion in a state in which a tape cartridge according to a third embodiment is installed on a cartridge installation portion.
Figure 11B:
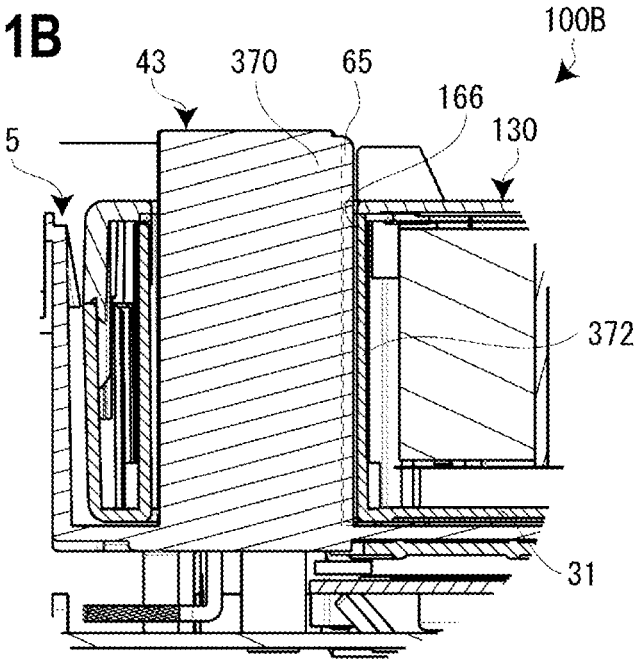
Figure 12A:
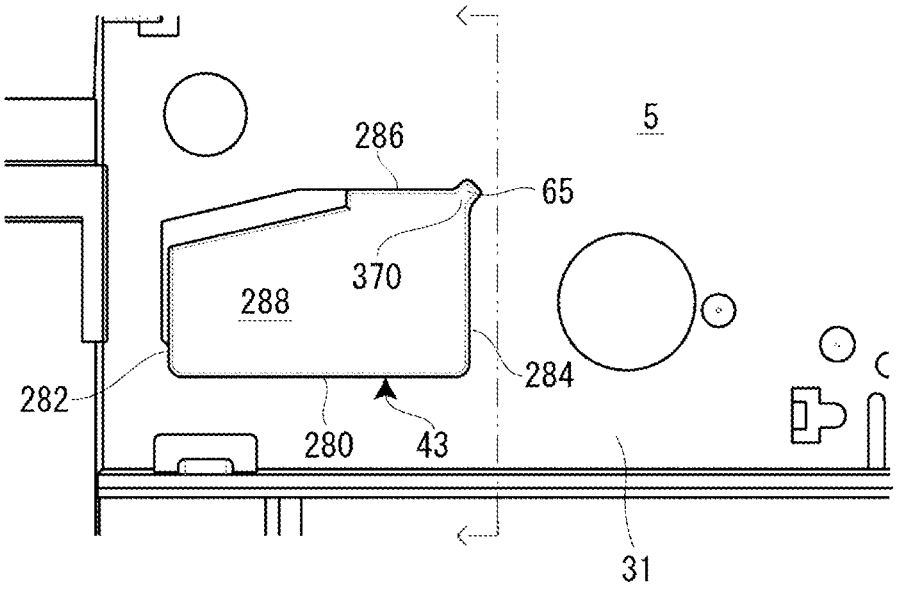
FIGS. 12A and 12B are, respectively, an enlarged plan view and an enlarged side surface view in the vicinity of the head cover of the cartridge installation portion.
Figure 12B:
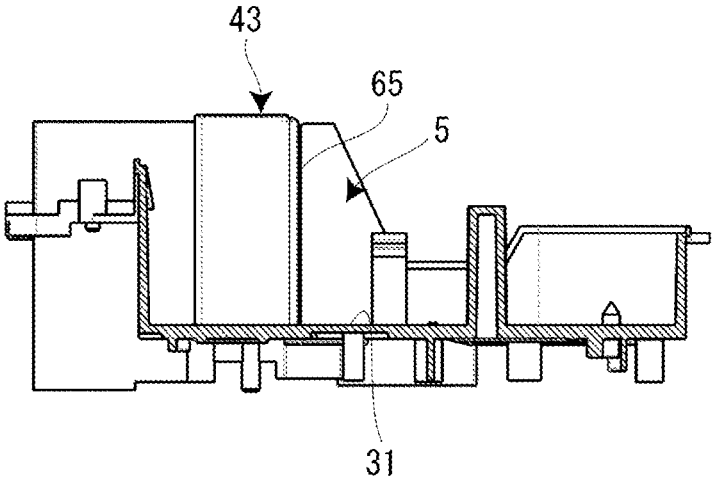

As shown in FIGS. 11A and 11B, the head cover 43 includes a main-body-side contact portion 65, which is provided to project to the tape cartridge 100B, at an edge portion 370 on the side of the rotation supporting shaft 63. The insertion opening 134 defined by the opening peripheral wall portion 164 is a portion in which the head cover 43 of the cartridge installation portion 5 is inserted, and the opening peripheral wall portion 164 includes a cartridge-side contact portion 166 corresponding to the main-body-side contact portion 65 provided at the head cover 43. When the tape cartridge 100 is installed on the cartridge installation portion 5, the cartridge-side contact portion 166 of the tape cartridge 100B comes in contact with the main-body-side contact portion 65 of the head cover 43, whereby the tape cartridge 100B is positioned at the cartridge installation portion 5 (that will be described in detail later).

[Cartridge-Side Contact Portion and Main-Body-Side Contact Portion (Third Embodiment)]

Next, with reference to FIGS. 11A and 11B to FIG. 13, a description will be given in detail of the structure of the cartridge-side contact portion 166 of the tape cartridge 100B according to a third embodiment in conjunction with the structure of the main-body-side contact portion 65 of the head cover 43.

As shown in the enlarged views of FIGS. 11A and 11B and FIGS. 12A and 12B, on the head cover 43 provided to stand on the installation base 31 of the cartridge installation portion 5, the main-body-side contact portion 65 is provided at the edge portion 370 on the side of the rotation supporting shaft 63. The head cover 43 includes a rear covering side wall 280 covering the rear surface side of the printing head 21 and a left covering side wall 282 and a right covering side wall 284 (first covering side walls), respectively, extending from both outside ends of the rear covering side wall 280 at right angles. In addition, the head cover 43 includes a front covering side wall 286 (second covering side wall) covering the front half portion of the printing head 21 and a top covering wall 288 covering the printing head 21 from the upper side. Further, these walls are integrally formed with each other.

The main-body-side contact portion 65 projects from the edge portion 370 at which the right covering side wall 284 and the front covering side wall 286 cross each other. Specifically, the main-body-side contact portion 65 is formed in a rectangle shape in cross section and projects from the apex of the edge portion 370. In addition, the main-body-side contact portion 65 extends from the installation base 31 so as to be the same in height as the head cover 43. The head cover 43 and the installation base 31 are integrally formed (molded) with each other as described above, and the main-body-side contact portion 65 is also integrally formed (molded) with the head cover 43 and the installation base 31.

Figure 13:
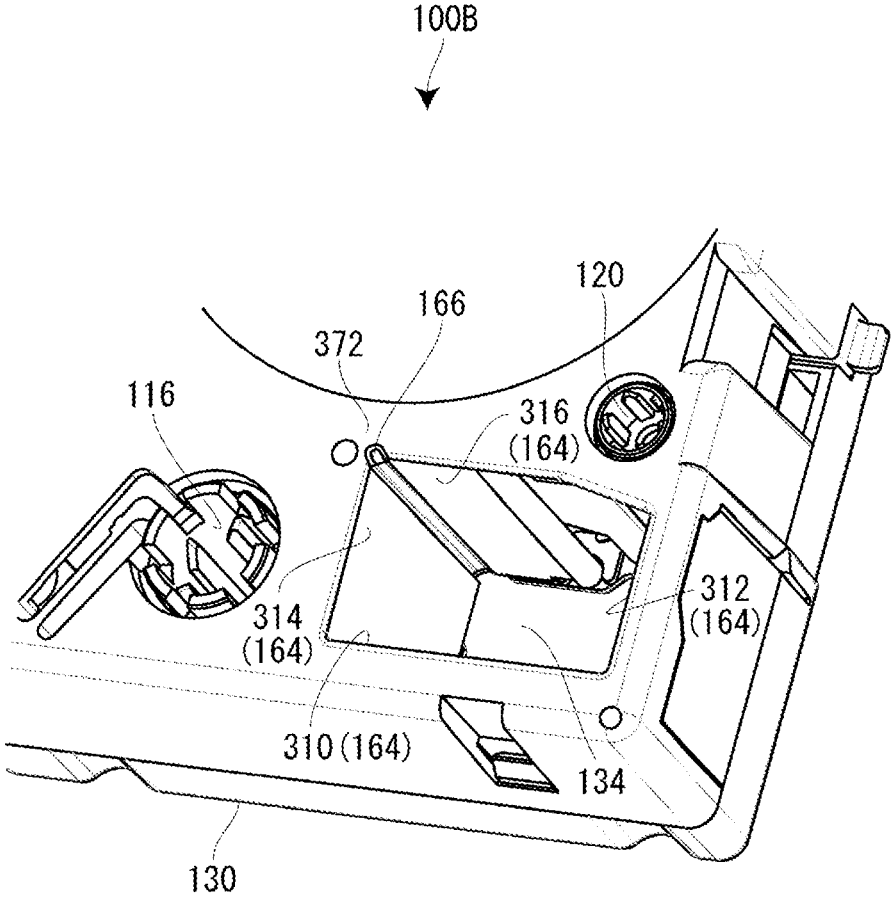
FIG. 13 is an enlarged perspective view in the vicinity of the cartridge-side contact portion of the tape cartridge according to the third embodiment.

As shown in the enlarged views of FIGS. 11A and 11B and FIG. 13, the cartridge-side contact portion 166 of the tape cartridge 1005 for receiving the main-body-side contact portion 65 is formed at a corner portion 370 of the opening peripheral wall portion 164 defining the insertion opening 134, the corner portion 370 corresponding to the edge portion 370. As shown in FIGS. 7A and 75, the cartridge-side contact portion 166 is positioned in the vicinity of the imaginary line L connecting the platen roller 120 and the winding-up core 116 together. The opening peripheral wall portion 164 includes a rear opening inside wall 310 corresponding to the rear covering side wall 280 and a left opening inside wall 312 corresponding to the left covering side wall 282. In addition, the opening peripheral wall portion 164 includes a right opening inside wall 314 corresponding to the right covering side wall 284 and a front opening inside wall 316 corresponding to the front covering side wall 286. Further, the rear covering side wall 280 and the rear opening inside wall 310 face each other with a gap therebetween. Similarly, the left covering side wall 282 and the left opening inside wall 312, the right covering side wall 284 and the right opening inside wall 314, and the front covering side wall 286 and the front opening inside wall 316 also face each other with a gap therebetween. For example, the cartridge-side contact portion 166 may be positioned on the right opening inside wall 314, the front opening inside wall 316 or both of the right opening inside wall 314 and the front opening inside 316.

The cartridge-side contact portion 166 is recessed at the corner portion 372 at which the right opening inside wall 314 and the front opening inside wall 316 cross each other. In this case, the cartridge-side contact portion 166 is formed in a rectangle shape in cross section, i.e., a shape complementary to the main-body-side contact portion 65 formed in a rectangle shape in cross section. In addition, the cartridge-side contact portion 166 is successively formed from the front side to the rear side of the cartridge casing 130 so as to correspond to the main-body-side contact portion 65. Further, the cartridge-side contact portion 166 comes in contact with and fits in the main-body-side contact portion 65 in a direction crossing the imaginary line L connecting the platen roller 120 and the winding-up core 116 together. Note that the cartridge-side contact portion 166 and the main-body-side contact portion 65 do not come in contact with each other in the figures. However, when the tape cartridge 100B moves by a tolerance with the application of rotation moments, both of the contact portions 166 and 65 come in contact with each other to restrict the movement of the tape cartridge 100B.

The cartridge-side contact portion 166 includes two side wall surfaces 374 parallel to each other, and the two side wall surfaces 374 come in contact with the side surfaces of the main-body-side contact portion 65. Thus, the cartridge-side contact portion 166 (the cartridge casing 130) is positioned in the direction of the imaginary line L (direction orthogonal to the recessed direction) by the main-body-side contact portion 65. Note that the two side wall surfaces 374 preferably include respective slant surfaces so as to expand toward the side of the installation base 31. In this way, since the slant surfaces function as guides for installing the tape cartridge 100B, the cartridge casing 130 can be accurately positioned in the direction of the imaginary line L.

In the third embodiment described above, when the tape cartridge 100B is installed on the cartridge installation portion 5, the cartridge-side contact portion 166 of the tape cartridge 100B fits in and butts against the main-body-side contact portion 65 of the head cover 43. Since the cartridge-side contact portion 166 exists on the imaginary line L (including its vicinity as is clear from FIGS. 11A and 11B)

connecting the platen roller 120 and the winding-up core 116 together, rotation forces (rotation moments) based on the driving forces of the platen driving shaft 45 and the winding-up driving shaft 47 have almost no vector components in directions in which the rotation forces cancel each other and thus a combined force (resultant force) is generated. Therefore, even if the rotation forces (rotation moments) of the platen driving shaft 45 and the winding-up driving shaft 47 are applied to the tape cartridge 100B, the main-body-side contact portion 65 and the cartridge-side contact portion 166 are caused to butt against each other by the combined force described above to reduce the positional deviation of the tape cartridge 100B. Accordingly, reduction in printing quality due to the positional deviation of the tape cartridge 100B can be prevented.

Note that although the main-body-side contact portion 65 is formed to be the same in height as the head cover 43 in the third embodiment, it may be shorter (lower) than the head cover 43. Similarly, the cartridge-side contact portion 166 may be formed to be shorter. In addition, a plurality of types of the tape cartridges 100E having a plurality of thicknesses according to a plurality of widths of the printing tape 102 is available as described above. If the tape cartridge 100 is one having a large thickness, the insertion opening 34 in which the printing head 21 (the head cover 43) is inserted is not limited to a through hole but may a bag hole having a top so long as it can accommodate the printing head 21. In this case, the cartridge-side contact portion 166 is only required to have a length within the range of the depth of the bag hole.

[Cartridge-Side Contact Portion and Main-Body-Side Contact Portion (Fourth Embodiment)]

Next, with reference to FIG. 14, a description will be given in detail of the structure of a cartridge-side contact portion 166A of a tape cartridge 1000 according to a fourth embodiment in conjunction with the structure of a main-body-side contact portion 65 of a head cover 43. In addition, components different from those of the third embodiment will be mainly described in the fourth embodiment.

Figure 14:
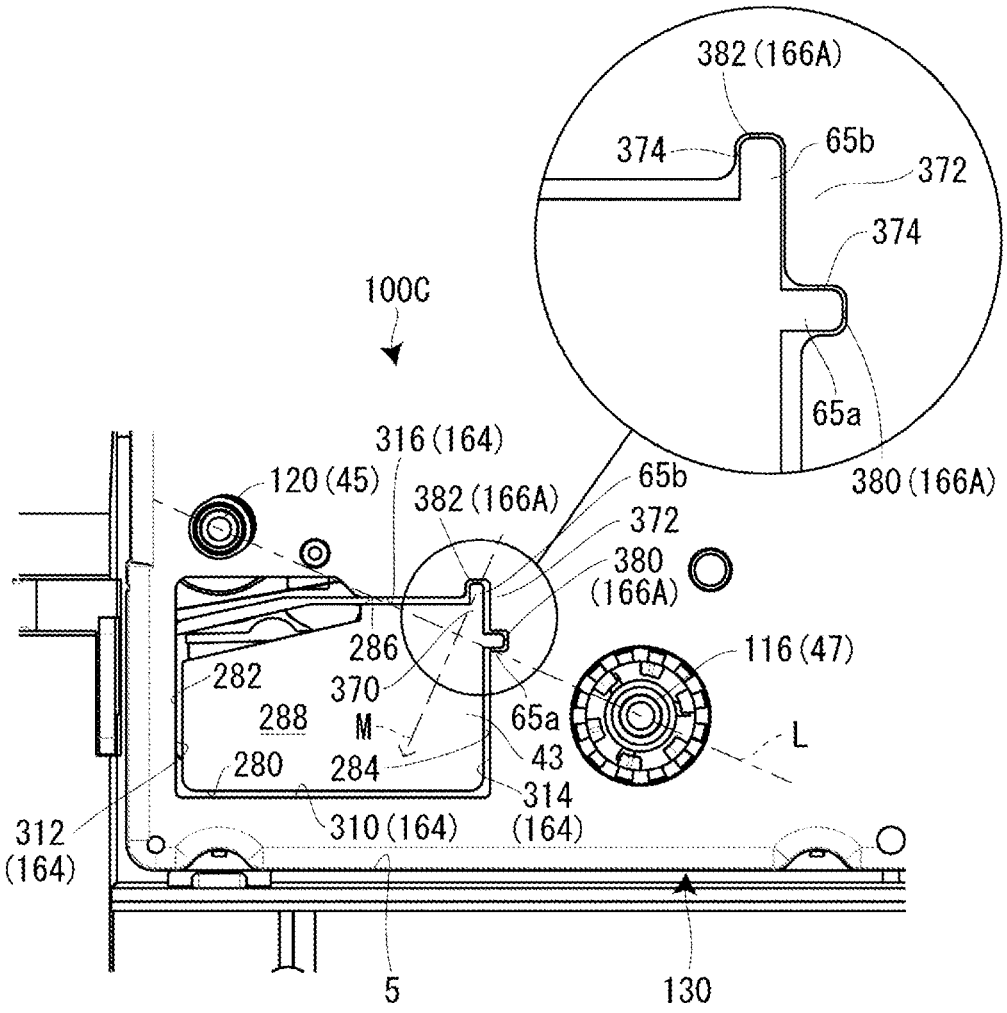
FIG. 14 is an enlarged plan view in the vicinity of a cartridge-side contact portion in a state in which a tape cartridge according to a fourth embodiment is installed on a cartridge installation portion.

As shown in FIG. 14, in the fourth embodiment as well, the main-body-side contact portion 65 projects from an edge portion 370 at which a right covering side wall 284 and a front covering side wall 286 of a head cover 43 cross each other. Specifically, in the vicinity of the apex of the edge portion 370, the main-body-side contact portion 65 includes a first convex portion 65*a* formed in a rectangle shape in cross section and projecting from the right covering side wall 284 and a second convex portion 65*b* formed in a rectangle shape in cross section and projecting from the front covering side wall 286. In addition, the first convex portion 65*a* and the second convex portion 65*b* extend from an installation base 31 so as to be the same in height as the head cover 43. Note that variations in the height are the same as those of the third embodiment.

On the other hand, the cartridge-side contact portion 166A is recessed at a corner portion 372 at which a right opening inside wall 314 and a front opening inside wall 316 of an opening peripheral wall portion 164 cross each other. Specifically, the cartridge-side contact portion 166A includes a first concave portion 380 recessed on the right opening inside wall 314 so as to correspond to the first convex portion 65*a*. In addition, the cartridge-side contact portion 166A includes a second concave portion 382 recessed on the front opening inside wall 316 so as to correspond to the second convex portion 65*b*. In this case as well, the first concave portion 380 is formed in a rectangle shape in cross section, i.e., a shape complementary to the first convex portion 65*a*, and the second concave portion 382 is formed in a rectangle shape in cross section, i.e., a shape complementary to the second convex portion 65*b*.

In addition, each of the first concave portion 380 and the second concave portion 382 is successively formed from the front side to the rear side of a cartridge casing 130. In this case as well, the first concave portion 380 and the second concave portion 382 have two respective side wall surfaces 374 parallel to each other, and the two side wall surfaces 374 come in contact with the corresponding side surfaces of the first convex portion 65*a* and the second convex portion 65*b*. Thus, the cartridge casing 130 is positioned in the back-and-forth and the right-and-left directions.

In the fourth embodiment described above, when the tape cartridge 100C is installed on a cartridge installation portion 5, the first concave portion 380 and the second concave portion 382 (the cartridge-side contact portion 166A) of the tape cartridge 100C, respectively, fit in and butt against the first convex portion 65*a* and the second convex portion 65*b* (the main-body-side contact portion 65) of the head cover 43. Therefore, even if the rotation forces (rotation moments) of a platen driving shaft 45 and a winding-up driving shaft 47 are applied to the tape cartridge 100C, a positional deviation does not occur in the tape cartridge 100C.

[First Modified Example of Fourth Embodiment]

Next, a description will be given of a first modified example of the fourth embodiment with reference to FIG. 14 and FIGS. 15A and 15B. In this modified example, a cartridge-side contact portion 166A has the same shape as that of the cartridge-side contact portion 166A of the fourth embodiment (see FIG. 14) but a main-body-side contact portion 65 has a shape different from that of the main-body-side contact portion 65 of the fourth embodiment. Therefore, the main-body-side contact portion 65 will be described below.

Figure 15A:
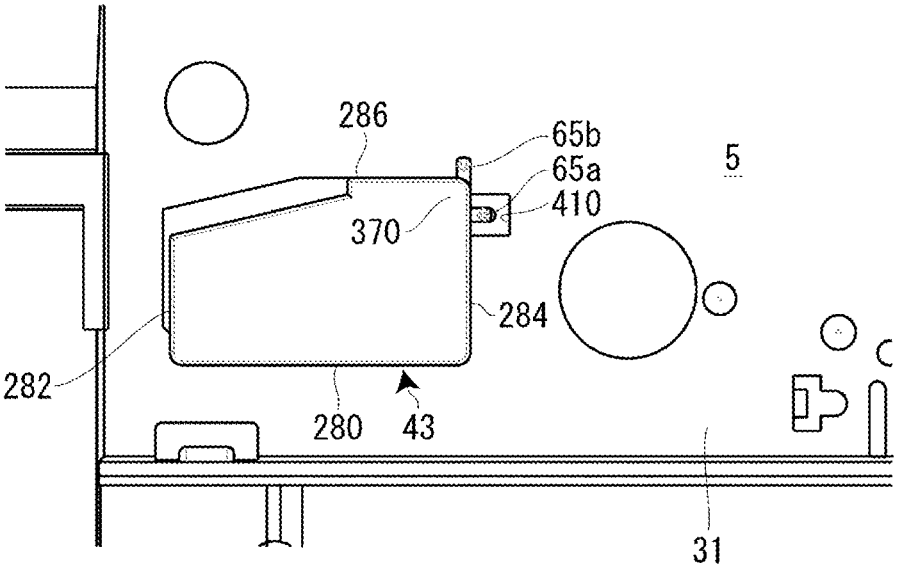
FIGS. 15A and 15B are, respectively, an enlarged plan view and an enlarged cross-sectional view in the vicinity of a head cover according to a first modified example of the fourth embodiment.
Figure 15B:
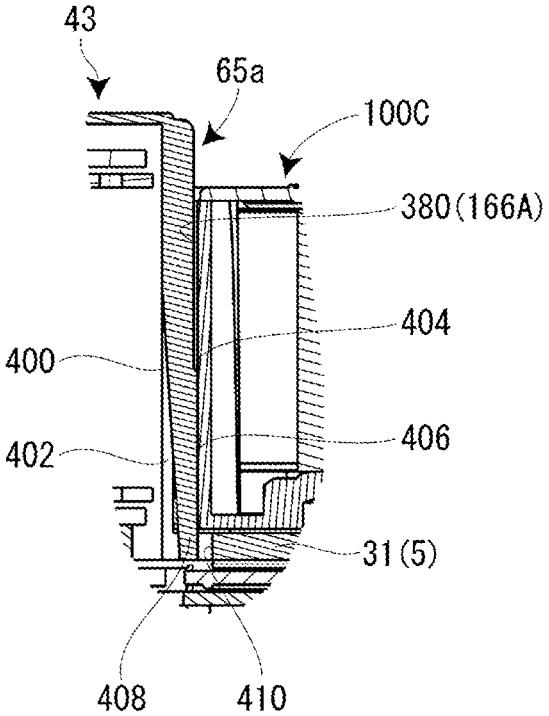

FIG. 15A is an enlarged plan view in the vicinity of a head cover 43, and FIG. 15B is an enlarged cross-sectional view in the vicinity of the head cover 43. As shown in these figures, the main-body-side contact portion 65 of the first modified example also has a first convex portion 65*a* and a second convex portion 65*b*, and the first convex portion 65*a* has a shape different from that of the first convex portion 65*a* of the fourth embodiment. The first convex portion 65*a* is integrally formed with the head cover 43, but a lower half 400 of the first convex portion 65*a* is formed to be tapered downward so as to make its portion on the side (inside) of the head cover 43 deeply cut. On the other hand, the head cover 43 has a slit portion 402 that receives the lower half 400 of the first convex portion 65*a*. That is, the lower half 400 of the first convex portion 65*a* has spring characteristics in a right-and-left direction shown in the figures.

In addition, the outside of the lower half 400 of the first convex portion 65*a* extends with a step 404, and an extending portion 406 contacts the cartridge-side contact portion 166A. Moreover, a lower end 408 of the first convex portion 65*a* is loosely inserted in a rectangle opening 410 of an installation base 31. When a tape cartridge 100C is installed, the first convex portion 65*a* contacts the first concave portion 380 of the cartridge-side contact portion 166A and presses (urges) the same to an outside (right direction shown in the figures). That is, when the tape cartridge 100C is installed on a cartridge installation portion, it is pressed in the right direction shown in the figures via the first convex portion 65*a* and the first concave portion 380.

As described above, since the first convex portion 65*a* has spring characteristics in the first modified example, the tape cartridge 100C is immovably positioned with respect to the head cover 43 in the right-and-left direction. Accordingly, a positional deviation in the tape cartridge 100C can be effectively prevented. Note that the second convex portion 65*b* may also have the same shape as that of the first convex portion 65*a*.

[Second Modified Example of Fourth Embodiment]

Next, a description will be given of a second modified example of the fourth embodiment with reference to FIGS. 16A and 16B. In this modified example as well, a cartridge-side contact portion 166A has the same shape as that of the cartridge-side contact portion 166A of the fourth embodiment (see FIG. 14), but a main-body-side contact portion 65 has a shape different from that of the main-body-side contact portion 65 of the fourth embodiment. In this case as well, the main-body-side contact portion 65 has a first convex portion 65*a* and a second convex portion 65*b*, and the first convex portion 65*a* has a shape different from that of the first convex portion 65*a* of the fourth embodiment.

Figure 16A:
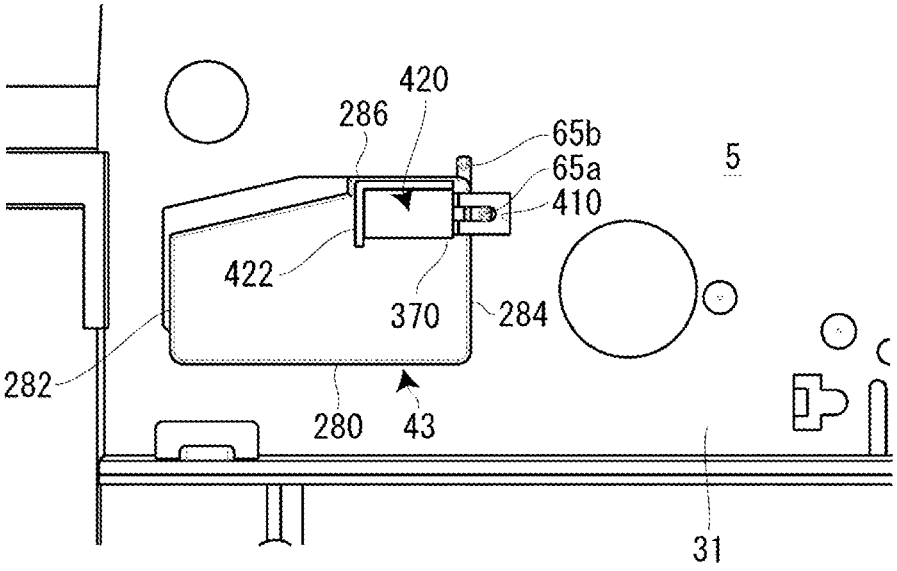
FIGS. 16A and 16B are, respectively, an enlarged plan view and an enlarged cross-sectional view in the vicinity of a head cover according to a second modified example of the fourth embodiment.
Figure 16B:
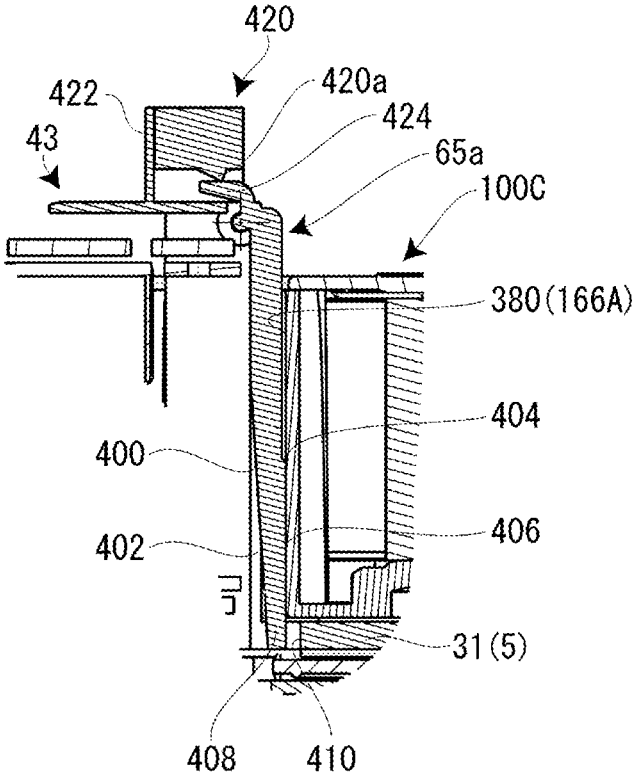

FIG. 16A is an enlarged plan view in the vicinity of a head cover 43, and FIG. 16B is an enlarged cross-sectional view in the vicinity of the head cover 43. As shown in these figures, in the second modified example, a detection switch 420 is provided on the upper surface of the edge portion 370 of the head cover 43, and the installation of the tape cartridge 100C is detected by the cooperation between the detection switch 420 and the first convex portion 65*a*.

An attachment piece 422 is integrally provided to stand on the upper surface of the head cover 43, and the detection switch 420 is downwardly attached to the attachment piece 422. In addition, the detection switch 420 is constituted of a micro switch embedding a spring for urging the switch end 420*a*, or the like.

On the other hand, the first convex portion 65*a* is formed separately from the head cover 43 and rotatably supported at the upper portion of the head cover 43. A lower half 400 of the first convex portion 65*a* has the same shape as that of the first convex portion 65*a* of the first modified example, and the head cover 43 has a slit portion 402 correspondingly. An upper half 424 of the first convex portion 65*a* extends in an "L"-shape and contacts the switch ends 420*a* of the detection switch 420.

When the tape cartridge 100C is installed, the first convex portion 65*a* contacts a first concave portion 380 of a cartridge-side contact portion 166A and slightly rotates. The detection switch 420 is turned ON with the rotation, and the installation of the tape cartridge 100C is detected. In addition, when the tape cartridge 100C is removed, the removal of the tape cartridge 100C is detected in an opposite procedure. On the other hand, the first convex portion 65*a*, which rotates with the installation of the tape cartridge 100C, undergoes an urging force from the embedded spring of the detection switch 420 and presses (urges) the first concave portion 380 to an outside (right direction shown in the figures). That is, when the tape cartridge 1000 is installed on a cartridge installation portion 5, it is pressed in the right direction shown in the figures via the first convex portion 65*a* and the first concave portion 380.

As described above, according to the second modified example, the installation of the tape cartridge 1000 can be detected by the cooperation between the detection switch 420 and the first convex portion 65*a*. In addition, since the spring force (embedded spring) of the detection switch 420 acts on the first convex portion 65*a*, the tape cartridge 100C is immovably positioned with respect to the head cover 43 in the right-and-left direction. Accordingly, a positional deviation in the tape cartridge 100C can be effectively prevented.

[Cartridge-Side Contact Portion and Main-Body-Side Contact Portion (Fifth Embodiment)]

Next, with reference to FIG. 17, a description will be given in detail of the structure of a cartridge-side contact portion 166B of a tape cartridge 100D according to a fifth embodiment in conjunction with the structure of a main-body-side contact portion 65 of a head cover 43. In addition, components different from those of the third embodiment will be mainly described in the fifth embodiment.

Figure 17:
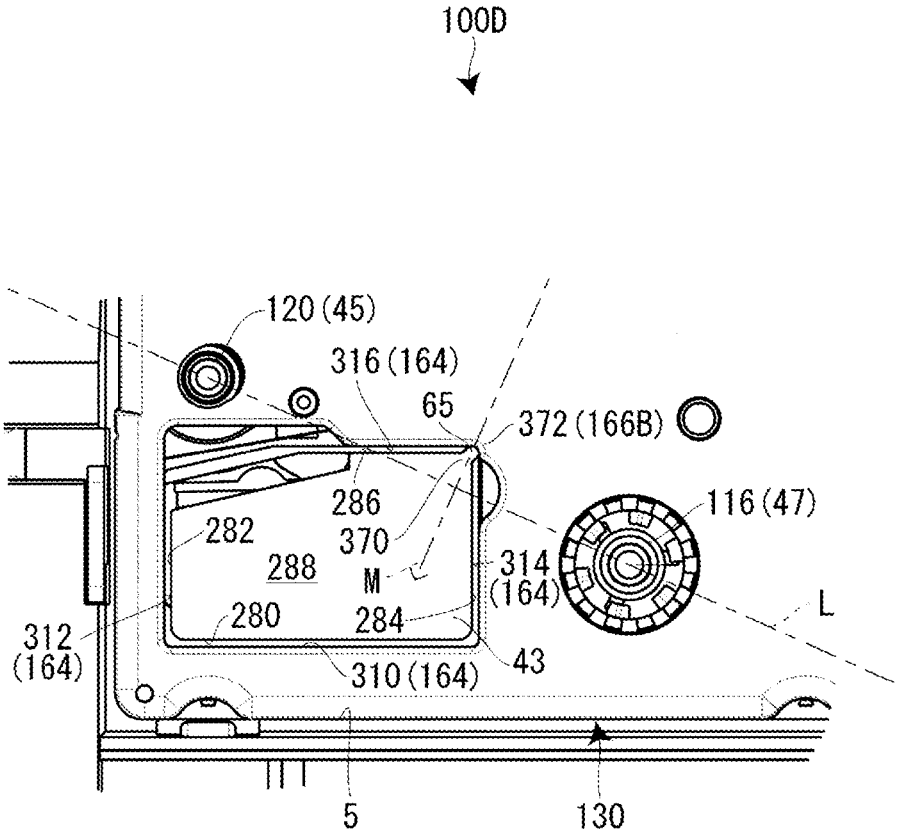
FIG. 17 is an enlarged plan view in the vicinity of a cartridge-side contact portion in a state in which a tape cartridge according to a fifth embodiment is installed on a cartridge installation portion.

As shown in FIG. 17, in this embodiment, the main-body-side contact portion 65 of the head cover 43 is formed to be shorter than the main-body-side contact portion 65 of the first embodiment. Note that variations in the height are the same as those of the third embodiment.

As described above, a gap is provided between a right covering side wall 284 and a right opening inside wall 314. In addition, a gap is provided between a front covering side wall 286 and a front opening inside wall 316. Thus, a gap is also provided between an edge portion 370 of the head cover 43 and a corner portion 372 of the tape cartridge 100D.

The main-body-side contact portion 65 of this embodiment projects from the head cover 43 with a projection size corresponding to the gap between the edge portion 370 and the corner portion 372. On the other hand, the inside corner of the corner portion 372 at which the right opening inside wall 314 and the front opening inside wall 316 cross each other comes in contact with the main-body-side contact portion 65. That is, the cartridge-side contact portion 166B of the fifth embodiment is constituted of the inside corner of the corner portion 372. In other words, the inside corner of the corner portion 372 serves as the cartridge-side contact portion 166B. In this case, the inside corner of the corner portion 372 is formed in an arc shape at the request of molding, and the tip of the main-body-side contact portion 65 corresponding to the inside corner is correspondingly formed in an arc shape (complementary arc shape).

In the fifth embodiment described above, when the tape cartridge 100D is installed on a cartridge installation portion 5, the corner portion 372 (the cartridge-side contact portion 166B) of the tape cartridge D butts against the main-body-side contact portion 65 of the head cover 45. Therefore, even if the rotation forces (rotation moments) of a platen driving shaft 45 and a winding-up driving shaft 47 are applied to the tape cartridge 100D, a positional deviation does not occur in the tape cartridge 100D.

Note that in the third to fifth embodiments described above, the main-body-side contact portion 65 is provided at the edge portion 370 or in the vicinity of the edge portion 370, and the cartridge-side contact portion 166 is provided at the corner portion 372 or in the vicinity of the corner portion 372. However, without being limited to these positions, the function and the effect of the present invention can be achieved on the condition that the cartridge-side contact portion 166 is positioned on the imaginary line L (including its vicinity) shown in FIGS. 11A and 11B and connecting the platen roller 120 and the winding-up core 116 together. In addition, the cartridge-side contact portion 166 is exemplified as a concave portion or a corner portion. However, the cartridge-side contact portion 166 is not necessarily limited to such a form. For example, only if the cartridge-side contact portion 166 is positioned on the imaginary line L (including its vicinity) connecting the platen roller 120 and the winding-up core 116 together and receives forces from the main-body-side contact portion 65, it may be merely a part of the wall of the opening peripheral wall portion 164, the part facing the main-body-side contact portion 65.

What is claimed is:

1. A tape cartridge detachably installed in a tape printing apparatus having a cartridge installation portion on which the tape cartridge is installed, a tape feeding mechanism portion that feeds a printing tape from the installed tape cartridge and feeds an ink ribbon in synchronization with the feeding of the printing tape, a printing head portion that performs printing on the printing tape and is configured to be movable between a printing position and a retracting position, a head cover provided on the cartridge installation portion, and a convex portion that projects from an outside surface of the head cover and guides installation of the tape cartridge, the tape cartridge comprising:

the printing tape;

the ink ribbon;

a platen roller that receives power from the tape feeding mechanism portion and faces the printing head portion so that the printing tape and the ink ribbon are disposed between the platen roller and the printing head at the printing position;

a cartridge casing that accommodates the printing tape, the ink ribbon, and the platen roller;

an insertion opening that is provided on the cartridge casing and in which the head cover is inserted when the tape cartridge is installed on the cartridge installation portion; and a facing portion that is provided on an opening peripheral wall portion of the insertion opening and receives the convex portion to restrict a displacement of the tape cartridge in the cartridge installation portion, wherein:

the head cover includes three covering side walls having:

a first covering side wall covering a rear surface side of the printing head portion, and two second covering side walls, respectively, extending from both outside ends of the first covering side wall, the opening peripheral wall portion of the insertion opening includes three opening inside walls having:

a first opening inside wall corresponding to a first covering side wall, and two second opening inside walls corresponding to the two second covering side walls, the three opening inside walls are formed in shapes complementary to the three covering side walls when seen from an installation direction in which the tape cartridge is installed in the tape printing apparatus, the facing portion is a concave portion, the concave portion includes a concave-portion bottom wall surface, and the concave-portion bottom wall surface includes a slant surface ascending in the installation direction.

2. The tape cartridge according to claim 1, wherein the concave portion relatively fits in the convex portion.

3. The tape cartridge according to claim 1, wherein the concave portion is provided on the first opening inside wall so as to correspond to the convex portion projecting from an outside surface of the first covering side wall extending in the same direction as the feeding direction of the printing tape.

4. The tape cartridge according to claim 1, wherein the concave portion is provided on each of the two second opening inside walls with respect to the convex portion projecting from each of outside surfaces of the two second covering side walls.

5. The tape cartridge according to claim 1, wherein the concave portion includes two concave-portion side wall surfaces, and the tape cartridge is positioned by the two concave-portion side wall surfaces and the convex portion in a direction crossing a direction in which the convex portion projects.

6. The tape cartridge according to claim 1, wherein the concave portion corresponds to the convex portion extending from an installation base surface of the cartridge installation portion to a position close to an end position of a feeding path of the ink ribbon on a front side in the installation direction, and the concave portion extends from an end surface of the three opening inside walls on the front side in the installation direction to the position close to the end position.

7. The tape cartridge according to claim 6, wherein the three opening inside walls include an inside wall main body and a corner portion at which the inside wall main body and a casing wall on a side of the installation base surface cross each other, and the concave portion is constituted of a concave groove on the corner portion and an opening on the inside wall main body.

8. The tape cartridge according to claim 6, wherein the cartridge casing includes two casings separable in the installation direction, and the concave portion is provided on one of the casings positioned closer to a front side in the installation direction.

9. A tape cartridge detachably installed on a cartridge installation portion of a tape printing apparatus, the cartridge installation portion on which the tape cartridge having a printing tape and an ink ribbon are installed being provided with a first output portion that outputs forward rotation power to feed the printing tape, a second output portion that outputs reverse rotation power to wind up the ink ribbon, and a main-body-side contact portion that is allowed to come in contact with the tape cartridge when the tape cartridge is installed, the tape cartridge comprising:

when being installed on the cartridge installation portion, a first input portion to which the forward rotation power is input from the first output portion of the tape printing apparatus;

a second input portion to which the reverse rotation power is input from the second output portion of the tape printing apparatus;

a cartridge-side contact portion that is allowed to come in contact with the main-body-side contact portion of the tape printing apparatus, the cartridge-side contact portion existing on an imaginary line connecting the first output portion and the second output portion together or existing near the imaginary line and so as to resist rotation forces generated in the tape cartridge by rotation forces of the first output portion and the second output portion of the tape printing apparatus; and an insertion opening that allows a head cover to be inserted in the insertion opening when the tape cartridge is installed into the cartridge installation portion on which a printing head portion and the head cover having a plurality of edge portions are provided and the main-body-side contact portion projects from one of the edge portions of the head cover, wherein the head cover covers a side of a rotation supporting shaft of the printing head portion, includes a first covering side wall and a second covering side wall crossing each other, and has the main-body-side contact portion projecting from the edge portion at which the first covering side wall and the second covering side wall cross each other, an opening peripheral wall portion defining the insertion opening includes a first opening inside wall corresponding to the first covering side wall and a second opening inside wall crossing the first opening inside wall and corresponding to the second covering side wall, and a corner portion at which the first opening inside wall and the second opening inside wall cross each other serves as the cartridge-side contact portion.

10. The tape cartridge according to claim 9, wherein the first input portion is included in a platen roller configured to be rotatable, and the second input portion is included in a winding-up core configured to be rotatable.

11. The tape cartridge according to claim 9, wherein the cartridge-side contact portion receives the main-body-side contact portion.

12. The tape cartridge according to claim 9, wherein the cartridge-side contact portion is formed in a shape expanding toward an installation direction to the cartridge installation portion.

13. The tape cartridge according to claim 9, further comprising:

an insertion opening that allows the head cover to be inserted in the insertion opening, wherein a printing head portion and a head cover are provided on the cartridge installation portion, the main-body-side contact portion projects from the head cover, and the cartridge-side contact portion is a portion facing the main-body-side contact portion of an opening peripheral wall portion defining the insertion opening.

* * * * *